US009850043B2

(12) United States Patent
Mithal et al.

(10) Patent No.: US 9,850,043 B2
(45) **Date of Patent: *Dec. 26, 2017**

(54) LID FEATURING EASE OF USE AND IMPROVED RELEASE FROM A TRAY OR CONTAINER

(71) Applicant: Waddington North America, Inc., Chelmsford, MA (US)

(72) Inventors: Ashish K Mithal, Chelmsford, MA (US); Matthew J Wichmann, Cresent Springs, KY (US); William A Gallop, Westminster, MA (US)

(73) Assignee: Waddington North America, Inc, Chelmsford, MA (US)

( * ) Notice: Subject to any disclaimer, the term of this patent is extended or adjusted under 35 U.S.C. 154(b) by 4 days.

This patent is subject to a terminal disclaimer.

(21) Appl. No.: 15/181,920

(22) Filed: Jun. 14, 2016

(65) Prior Publication Data

US 2016/0288964 A1 Oct. 6, 2016

Related U.S. Application Data

(63) Continuation-in-part of application No. 14/242,972, filed on Apr. 2, 2014, now abandoned, which is a (Continued)

(51) Int. Cl.
*B65D 43/26* (2006.01)
*B65D 43/06* (2006.01)
(Continued)

(52) U.S. Cl.
CPC ..... *B65D 43/26* (2013.01); *B65B 69/00* (2013.01); *B65D 21/0219* (2013.01);
(Continued)

(58) Field of Classification Search
CPC ..... B65D 43/26; B65D 69/00; B65D 85/16; B65D 43/0212; B65D 51/245;
(Continued)

(56) References Cited

U.S. PATENT DOCUMENTS 236,266 A 1/1881 Shirley
622,564 A 4/1899 Tebbetts
(Continued)

OTHER PUBLICATIONS

Cardinal Glassware, Arcoroc, Cardinal International, 30 Corporate Drive, Wayne, NJ 07470 (6 pages) pp. 84 and 85 of Catalog.

*Primary Examiner* — James N Smalley

(57) ABSTRACT

A lid and tray assembly includes at least two lift tabs and/or indentations at separated but not directly opposing locations about the lid periphery that can be actuated simultaneously or sequentially to provide two distinct locations from which initial disengagements can extend and merge to enable easy removal of the entire lid. Embodiments further include locations that can be pressed while corresponding tabs are lifted. Some embodiments include a peripheral skirt that is short enough to allow a user's fingers to pass beneath and support the tray sidewalls when lifting the tray-lid assembly from a horizontal surface, avoiding any need for the lid engagement to bear the weight of the tray and its contents. Lid-tray engagement can be by means of inserting a lid peripheral rim into a tray lip groove, or by engaging a lid rim undercut with a tray lip undercut.

22 Claims, 20 Drawing Sheets

Related U.S. Application Data continuation of application No. 12/652,483, filed on Jan. 5, 2010, now Pat. No. 8,701,930.

(60) Provisional application No. 61/142,423, filed on Jan. 5, 2009.

(51) Int. Cl.

| | |
|---|---|
| ***B65D 51/24*** | (2006.01) |
| ***B65B 69/00*** | (2006.01) |
| ***B65D 43/02*** | (2006.01) |
| ***B65D 21/02*** | (2006.01) |

(52) U.S. Cl.

CPC ..... *B65D 43/0212* (2013.01); *B65D 43/06* (2013.01); *B65D 51/245* (2013.01); *B65D 2543/00064* (2013.01); *B65D 2543/00092* (2013.01); *B65D 2543/00101* (2013.01); *B65D 2543/00296* (2013.01); *B65D 2543/00361* (2013.01); *B65D 2543/00407* (2013.01); *B65D 2543/00416* (2013.01); *B65D 2543/00527* (2013.01); *B65D 2543/00537* (2013.01); *B65D 2543/00648* (2013.01); *B65D 2543/00685* (2013.01); *B65D 2543/00731* (2013.01); *B65D 2543/00796* (2013.01); *B65D 2543/00833* (2013.01); *B65D 2543/00842* (2013.01)

(58) Field of Classification Search

CPC ..... B65D 43/06; B65D 2543/00731; B65D 2543/00416; B65D 2543/00527; B65D 2543/00537; B65D 2543/00296; B65D 2543/00685; B65D 2543/00; B65D 2543/00796; B65D 2543/00842; B65D 2543/00407; B65D 2543/00092; B65D 2543/00648; B65D 2543/00064; B65D 2543/00833

USPC ..... 220/780, 793, 4.21

See application file for complete search history.

(56) References Cited

U.S. PATENT DOCUMENTS

| | | | |
|---|---|---|---|
| 1,034,636 | A | 8/1912 | McNair |
| D43,852 | S | 4/1913 | Sanford |
| D52,727 | S | 12/1918 | Beiswanger |
| 1,441,010 | A | 1/1923 | McGuire |
| D69,040 | S | 12/1925 | Loomis |
| D69,929 | S | 4/1926 | Zimmerman |
| 1,629,358 | A | 5/1927 | Padgett |
| D99,555 | S | 5/1936 | Smith |
| D124,290 | S | 12/1940 | Chaplin |
| 2,259,856 | A | 10/1941 | Moore |
| D164,407 | S | 9/1951 | Cowan |
| D174,832 | S | 5/1955 | Nowak |
| 3,047,179 | A | 7/1962 | Madej |
| D195,699 | S | 7/1963 | Bostrom |
| 3,101,857 | A | 8/1963 | Freedman |
| 3,546,752 | A | 12/1970 | Sargent |
| 3,589,551 | A | 6/1971 | Haggbom |
| 3,655,089 | A | 4/1972 | Tower |
| 3,688,942 | A | 9/1972 | Mitchell et al. |
| 3,707,240 | A | 12/1972 | Wilson |
| 3,889,842 | A | 6/1975 | Bennett |
| 4,049,187 | A | 9/1977 | Florian |
| 4,190,173 | A | 2/1980 | Mason |
| 4,241,855 | A | 12/1980 | Yoshioka |
| 4,331,255 | A | 5/1982 | Fournier |
| 4,494,672 | A | 1/1985 | Pearson |
| 4,589,569 | A | 5/1986 | Clements |
| 4,615,459 | A | 10/1986 | Clements |
| 4,619,372 | A | 10/1986 | McFarland |
| 4,620,665 | A | 11/1986 | McSherry |
| D287,207 | S | 12/1986 | Daenen et al. |
| 4,684,024 | A | 8/1987 | Ebrahim et al. |
| 4,687,117 | A | 8/1987 | Terauds |
| 4,721,210 | A | 1/1988 | Lawrence et al. |
| 4,753,365 | A | 6/1988 | Seppala |
| 4,782,975 | A | 11/1988 | Coy |
| 4,805,797 | A | 2/1989 | Natori |
| 4,899,902 | A | 2/1990 | Demars |
| 4,986,438 | A | 1/1991 | Borst |
| 5,050,758 | A | 9/1991 | Freeman et al. |
| 5,054,640 | A | 10/1991 | Tucker |
| 5,076,333 | A | 12/1991 | Law |
| 5,125,525 | A | 6/1992 | Tucker |
| 5,143,248 | A | 9/1992 | Sawatsky |
| 5,203,467 | A | 4/1993 | Tucker |
| 5,203,490 | A | 4/1993 | Roe |
| 5,205,473 | A | 4/1993 | Coffin, Sr. |
| 5,222,656 | A | 6/1993 | Carlson |
| 5,240,132 | A | 8/1993 | Tucker |
| 5,253,780 | A | 10/1993 | Adado |
| 5,253,781 | A | 10/1993 | Van Melle et al. |
| D344,210 | S | 2/1994 | Cousins et al. |
| D345,912 | S | 4/1994 | Krupa |
| D346,554 | S | 5/1994 | Krupa |
| 5,348,181 | A | 9/1994 | Smith et al. |
| D352,000 | S | 11/1994 | Hansen et al. |
| D353,519 | S | 12/1994 | Wolfenden |
| 5,392,949 | A | 2/1995 | McKenna |
| 5,398,843 | A | 3/1995 | Warden |
| D358,091 | S | 5/1995 | Warburton |
| 5,425,497 | A | 6/1995 | Sorensen |
| D361,696 | S | 8/1995 | Wolfenden |
| D364,090 | S | 11/1995 | Krupa |
| 5,490,609 | A | 2/1996 | Lane et al. |
| 5,538,154 | A | 7/1996 | Von Holdt |
| 5,538,157 | A | 7/1996 | Proshan |
| 5,540,350 | A | 7/1996 | Lansky |
| 5,542,670 | A | 8/1996 | Morano |
| D374,820 | S | 10/1996 | Knoss et al. |
| 5,579,949 | A | 12/1996 | Dykes et al. |
| 5,607,076 | A | 3/1997 | Anthony |
| 5,613,619 | A | 3/1997 | Van Melle |
| 5,613,720 | A | 3/1997 | Shaddy |
| 5,624,053 | A | 4/1997 | Freek et al. |
| 5,678,720 | A | 10/1997 | Van Melle |
| 5,695,086 | A | 12/1997 | Viola |
| D391,479 | S | 3/1998 | Poitras |
| D391,850 | S | 3/1998 | Krupa et al. |
| 5,752,646 | A | 5/1998 | Sandstrom |
| 5,765,716 | A | 6/1998 | Cai et al. |
| 5,772,111 | A | 6/1998 | Kirsch |
| 5,820,016 | A | 10/1998 | Stropkay |
| 5,839,601 | A | 11/1998 | Van Melle |
| 5,894,952 | A | 4/1999 | Mendenhall et al. |
| D411,714 | S | 6/1999 | Wilson et al. |
| D413,487 | S | 9/1999 | Vitali |
| D414,413 | S | 9/1999 | Brown |
| 5,947,323 | A | 9/1999 | Freek et al. |
| D415,024 | S | 10/1999 | McCann |
| D415,025 | S | 10/1999 | McCann |
| 5,960,987 | A | 10/1999 | Solland et al. |
| D416,445 | S | 11/1999 | Henry |
| 5,979,689 | A | 11/1999 | Lansky |
| 5,979,697 | A | 11/1999 | Kim |
| D420,285 | S | 2/2000 | Sagan et al. |
| D420,854 | S | 2/2000 | Michaeli |
| D421,202 | S | 2/2000 | Demers |
| 6,089,397 | A | 7/2000 | Van Melle |
| D435,197 | S | 12/2000 | Wellner |
| 6,199,711 | B1 | 3/2001 | Lansky |
| 6,216,904 | B1 | 4/2001 | Cagan |
| 6,260,727 | B1 | 7/2001 | Durdon |
| 6,296,141 | B1 | 10/2001 | Lukacevic |
| 6,305,571 | B1 | 10/2001 | Chu |
| D450,537 | S | 11/2001 | Hayes |
| D450,538 | S | 11/2001 | Benson |
| 6,311,863 | B1 | 11/2001 | Fleming |
| 6,318,584 | B1 | 11/2001 | Milan |
| 6,325,236 | B1 | 12/2001 | Wong |

(56) References Cited

U.S. PATENT DOCUMENTS

| | | | |
|---|---|---|---|
| D457,037 | S | 5/2002 | Hayes |
| 6,419,105 | B1 | 7/2002 | Bruce et al. |
| D461,678 | S | 8/2002 | Hayes |
| 6,488,173 | B2 | 12/2002 | Milan |
| 6,533,139 | B2 | 3/2003 | Lukacevic |
| 6,578,726 | B1 | 6/2003 | Schaefer |
| 6,612,456 | B1 | 9/2003 | Hundley et al. |
| 6,644,490 | B2 | 11/2003 | Clarke |
| 6,679,397 | B2 | 1/2004 | Smith et al. |
| 6,732,875 | B2 | 5/2004 | Smith et al. |
| 6,755,318 | B2 | 6/2004 | Burke |
| 6,811,049 | B2 | 11/2004 | Lukacevic |
| 6,874,649 | B2 | 4/2005 | Clarke et al. |
| 6,889,859 | B1 | 5/2005 | Leon |
| 6,889,860 | B2 | 5/2005 | Mazzarolo |
| 6,923,337 | B2 | 8/2005 | Hession et al. |
| 6,929,143 | B2 | 8/2005 | Mazzarolo |
| 7,032,773 | B2 | 4/2006 | Dees et al. |
| 7,063,224 | B2 | 6/2006 | Clarke et al. |
| 7,086,549 | B2 | 8/2006 | Kosmyna et al. |
| 7,100,790 | B2 | 9/2006 | Dark |
| 7,131,551 | B2 | 11/2006 | Smith |
| 7,134,566 | B2 | 11/2006 | Smith et al. |
| 7,134,570 | B1 | 11/2006 | Heath et al. |
| 7,156,251 | B2 | 1/2007 | Smith et al. |
| 7,246,715 | B2 | 7/2007 | Smith |
| 2002/0096530 | A1 | 7/2002 | Waller |
| 2003/0089713 | A1 | 5/2003 | Belt et al. |
| 2004/0232154 | A1 | 11/2004 | Smith et al. |
| 2005/0098581 | A1 | 5/2005 | Long et al. |
| 2005/0205587 | A1 | 9/2005 | Sampson et al. |
| 2006/0006184 | A1 | 1/2006 | Bohman |
| 2006/0096983 | A1 | 5/2006 | Patterson |
| 2006/0124645 | A1 | 6/2006 | Peitersen |
| 2007/0012710 | A1 | 1/2007 | Vovan |
| 2008/0011762 | A1 | 1/2008 | Boone |
| 2008/0156802 | A1 | 7/2008 | Yauk et al. |
| 2008/0156817 | A1 | 7/2008 | Roseblade et al. |
| 2008/0302798 | A1* | 12/2008 | Foldesi, Sr. ..... B65B 7/2878 220/276 |
| 2009/0050641 | A1 | 2/2009 | Ivey |
| 2009/0065518 | A1 | 3/2009 | Carnevali |
| 2009/0108006 | A1 | 4/2009 | Milan |
| 2012/0048774 | A1* | 3/2012 | Gingras ..... B65D 43/0254 206/565 |

* cited by examiner

LID FEATURING EASE OF USE AND IMPROVED RELEASE FROM A TRAY OR CONTAINER

RELATED APPLICATIONS

This application is a continuation in part of co-pending application Ser. No. 14/242,972, filed on Apr. 2, 2014. Application Ser. No. 14/242,972 is a continuation of application Ser. No. 12/652,483, filed on Jan. 5, 2010 (now U.S. Pat. No. 8,701,930 issued Apr. 22, 2014), which claims the benefit of U.S. Provisional Application No. 61/142,423 filed Jan. 5, 2009. All of these applications are incorporated herein by reference in their entirety for all purposes

FIELD OF THE INVENTION

This invention relates generally to lids adapted for use with trays and containers, and more particularly to lids featuring ease of use and improved release from trays and containers.

BACKGROUND OF THE INVENTION

Containers with detachable and re-attachable lids, including disposable food containers, trays and platters with compatible lids, are well known and are commonly employed in many industries, including food related industries such as restaurants, caterers, institutional food service establishments, cafeterias, and households.

A tray, serving platter, or container base for use in catering and other food service applications frequently features a lid or cover that is cooperatively engageable therewith for presenting, handling, transporting, and/or protecting a variety of food items. The tray or base usually has an upwardly projecting sidewall terminating in a rim. The base or tray rim may simply feature a lip area, or may include sealing ridges, channels or other locking mechanisms that are adapted for cooperative engagement with corresponding grooves, inverted channels, or other cooperative features which are integrated with the lid. Note that the terms "tray" and "base" are used generically herein to refer to any type of tray, serving platter, container, or other support base which is attachable to a lid or cover. Note also that the term "lid" is used generically herein to refer to any type of lid or cover that is compatible with and attachable to a "tray" or a "base".

Disposable lids for use with food containers and platters are usually thermoformed from a sheet of Polyethylene Terephthalate (PET) or Oriented Polystyrene (OPS) although other plastic materials may be employed. The lid is configured to fit the base, and may include an elevated and/or dome-shaped central portion to allow for comfortably accommodating a certain quantity or height of foods or other contents, and will preserve the shape, form, decorative appearance and/or the general presentation of items such as certain food preparations, including desserts, cakes, sandwiches, or other foods. Or the lid may be substantially flat, and may be attachable to a container which has sufficient depth to surround food items or other contents to be contained therein. In some approaches, once a lid has been engaged with a tray to form a first tray-lid assembly, a second tray-lid assembly can be stacked on top of the first tray-lid assembly, and thus a plurality of tray-lid assemblies can be stacked on top of each other for compact storage and for ease of transportation and handling.

In the case of food containment, it is paramount that food preparations be protected, and that inadvertent disengagement or removal of the lid from the tray be avoided. Therefore, in many cases one or more locking features and/or undercuts are provided at the periphery of the tray and/or the lid, resulting in a relatively tight interference fit between the lid and the tray. However, this tight interference fit can make it difficult for a user to disengage and/or remove the lid at the time of use, resulting in an inconvenience to the user at best, and spilling of the food at worst, as the user struggles to remove the lid from the tray. Depending on the material from which the lid is constructed, the lid may even tear or rip during removal, thereby rendering subsequent reengagement of the lid with tray or container ineffective or futile.

A typical method for disengaging a generic container-lid assembly is by holding the container with one hand and pulling the lid off with the other hand. Sometimes a tab or an indent is provided in either the lid or the container so as to facilitate creating an initial separation or opening between the lid and the container at the location of the tab or indent, and then separating the lid from the container around the entire periphery of the container-lid assembly. However, this method of disengaging or separating a lid from a container can be difficult if the container is shallow, for example if the container is in the form of a tray or plate covered by a lid having a raised portion. In such cases, it can be difficult to grasp the shallow base so as to pull it away from the lid.

A lid having a raised portion, herein referred to generically as a "dome" lid regardless of whether the lid is round, rectangular, or some other shape, may feature a downwardly projecting peripheral skirt that overhangs beyond the perimeter of the tray or container base. As will be appreciated by those skilled in the art, for a relatively shallow tray the overhang of the peripheral skirt of the lid can be almost as tall as the tray, making it even more difficult for a user to grasp the tray for lid removal, and making it difficult even to slide his or her fingers underneath the peripheral skirt of the lid for lifting and carrying of the tray-lid assembly. Instead, a user typically has to lift the tray-lid assembly by the peripheral edge of the lid without touching the tray. In this situation, the entire weight of the tray and its contents is thus borne by the locking or engagement mechanism between the tray and the lid, further necessitating that the tray and lid have a tight fit, which in turn makes it even more difficult to remove the lid from the tray.

A particular difficulty for removing lids from tray-lid assemblies of the type described above is encountered due to the fact that in many cases the lid is flexible and the periphery of the tray-lid assembly is relatively large compared to the size of the tab or indent that is provided with the lid or the tray for initiating separation of the lid from the tray. Consequently, when a user exerts an upward or downward force on the tab or indent provided in the lid or tray for pulling the tray-lid assembly apart, the rim of the lid tends to press opposingly inwardly at other locations, causing the lid to grip even more tightly onto the tray at those locations, and thereby rendering removal of the dome from the tray base extremely difficult, or at least cumbersome.

Thus, there is a need for a lid that is securely engageable with a tray or a container and yet can be conveniently removed from the tray or container with relative ease and without disturbing the contents of the tray or container. These and other needs are met by the lid of the present invention.

BRIEF SUMMARY OF THE INVENTION

A lid is claimed for a tray that enables secure and reliable engagement between the lid and the tray while enabling easy removal of the lid from the tray without disturbing contents supported by the tray and without applying undue stress to the lid. In particular, the present invention enables removal of the lid from a tray-lid assembly in a reversible manner, i.e. without damaging the lid during removal.

Note that except where the context requires a more specific definition, the term "tray" is used herein to refer generically to a tray, platter, dish, container, plate, or any other support base compatible with a lid or cover, and the term "lid" is used generically herein to refer to any sort of lid or cover compatible with a "tray," including flat lids and "dome" lids that include raised portions and have cross sectional profiles that are rectangular, rounded, or any other raised shape.

Note also that while the following discussion is presented in the context of describing feature(s) of a lid, whereby the feature(s) enable removal of the lid from a tray, the roles of the lid and the tray can be reversed without departing from the scope of the invention. In other words, a specific feature or features ascribed herein to the "lid" (or upper element) can be incorporated (in part or in total) into the "tray" (or lower element) of the tray-lid combination. For example, where embodiments are described as having two lift tabs and press areas in the lid, it will be understood that similar embodiments include one or both of the lift tabs and corresponding press areas in the base. Therefore, the invention applies generally to separable halves of a containing assembly comprising a first half and a second half, whereby terms used for convenience to describe one half of the containing assembly, such as "lid" and "cover," can generally be exchanged herein with terms used to describe the other half of the containing assembly, such as "tray," "container," and "support base," without departing from the meaning or scope of the invention.

The claimed lid facilitates separation of the lid from the tray-lid assembly by providing at least two tabs at two locations on the outer periphery of the lid and/or two indentations in the outer periphery of the tray that are separated, but not directly opposite to each other. The two tabs or indentations thereby provide at least two distinct locations for initial disengagement of the lid from the tray. By disengaging the lid from the tray at two or more separated locations about the rim, the tendency of the elastic lid to responsively grip the tray is overcome, and the lid is released from the tray without the user applying undue effort, without subjecting the lid to undue stress, and without unduly disturbing the contents of the tray-lid assembly.

An additional feature in embodiments of the present invention is to facilitate lifting of a tray-lid assembly securely from a flat surface by utilizing a lid construction that either does not have a peripheral skirt, or at most has only a peripheral skirt that is short enough to allow a user's fingers to reach underneath the skirt and support the sidewalls of the tray when lifting and/or carrying the tray-lid assembly, so that the entire weight of the tray-lid assembly, including any contents supported thereby, is not exclusively borne by the cooperative lid-tray engagement features.

Still another feature in some embodiments of the present invention is to provide a lid having a peripheral flange, sometimes referred to herein as a "rim horizontal section," wherein the peripheral flange has at least a first pressing area and a second pressing area that are cooperative with a first lifting tab and a second lifting tab. In some of these embodiments the lifting tabs are formed in a peripheral skirt of the lid, while in other embodiments they are outward extensions from the rim horizontal section, The first pressing area works cooperatively with the first lifting tab and the second pressing area works cooperatively with the second lifting tab such that during the process of removing the lid from the tray, a user presses the first pressing area and lifts the first lifting tab with one hand, while concurrently pressing the second pressing area and lifts the second lifting tab with the second hand. Once at least partial separations have been created at the first and second lifting tab locations, the separations propagate toward each other until they merge, such that the entire lid can be readily removed from the tray.

One general aspect of the present invention is a method for using and opening a container assembly. The method includes engaging a lid with a container base by cooperatively locking a lid engagement feature provided in the lid proximal to a peripheral boundary of the lid, with a base engagement feature provided in the container base proximal to a peripheral boundary of the container base, said lid including a first graspable member and a second graspable member proximal to the peripheral boundary of the lid in locations that are not directly opposite to each other, each of said graspable members extending beyond the peripheral boundary of the container base, flexing the first graspable member manually via a user's first hand, thereby rotating the first graspable member upward and disengaging a first portion of the lid engagement feature from a corresponding first portion of the base engagement feature, creating a first region of disengagement therebetween, flexing the second graspable member manually via the user's second hand, thereby rotating the second graspable member upward and disengaging a second portion of the lid engagement feature from a corresponding second portion of the base engagement feature, creating a second region of disengagement therebetween, and removing the lid from the container base by lifting said lid away from said container base.

In embodiments, the first and second regions of disengagement extend peripherally in both directions from the corresponding graspable members. In some embodiments, the first and second regions of disengagement merge to form a single region of disengagement that extends at least from the first graspable member to the second graspable member.

In other embodiments, said lid and container base engagement features are substantially round. In various embodiments, the lid further includes a first press location cooperative with the first graspable member and a second press location cooperative with the second graspable member.

In further embodiments, the lid includes visible indications associated with the first and second press locations suggesting that pressure be applied to the first and second press locations, and visible indications associated with the first and second graspable members suggesting that the first and second graspable members be lifted. And in some of these embodiments, the step of flexing the first graspable member manually via a user's first hand is accompanied by pressing on the first press location to facilitate disengagement at said first region, and the step of flexing the second graspable member manually via user's second hand is accompanied by pressing on the second press location to facilitate disengagement at said second region.

In certain embodiments, the lid includes visible indications associated with the first and second graspable members suggesting that the first and second graspable members be lifted.

In embodiments, the graspable members are lift tabs. In some embodiments, said lid is dome shaped. In other embodiments, said graspable members are sequentially flexed by at least one of a user's hands.

In certain embodiments, the first graspable member is flexed by a first hand of the user and the second graspable member is concurrently flexed by a second hand of the user. In further embodiments, the graspable members are located at an angular separation of between 20 degrees and 60 degrees.

In exemplary embodiments, the graspable members are located at an angular separation of between 25 degrees and 50 degrees. In various embodiments, at least one of the graspable members is located at a vertex of the peripheral boundary of the lid.

In embodiments, the first and second graspable members are located adjacent to either side of a vertex of the peripheral boundary of the lid. And in some embodiments, the material of construction of the lid is one of: polypropylene (PP), oriented polystyrene (OPS), polyethylene terephthalate (PET), styrene butadiene copolymer, and rubber modified styrene.

Another general aspect of the present invention is a method for releasing a lid from engagement with a container base. The method includes providing a container assembly that includes said lid engaged with said container base, the lid including a lid engagement feature proximal to a peripheral boundary of the lid, said lid engagement feature being engaged in mutual cooperation with a base engagement feature provided in the container base, a first graspable member and a second graspable member being attached to the lid proximal to the peripheral boundary of the lid in locations that are not directly opposite to each other, each of said graspable members extending beyond the peripheral boundary of the container base, a first press location being cooperative with the first graspable member and a second press location being cooperative with the second graspable member, flexing the first graspable member while pressing on the first press location, said flexing and pressing being performed manually via a user's first hand, thereby rotating the first graspable member upward and disengaging a first portion of the lid engagement feature from a corresponding first portion of the base engagement feature, creating a first region of disengagement therebetween, flexing the second graspable member while pressing on the second press location, said flexing and pressing being performed manually via the user's second hand, thereby rotating the second graspable member upward and disengaging a second portion of the lid engagement feature from a corresponding second portion of the base engagement feature, creating a second region of disengagement therebetween, and removing the lid from the container base by lifting said lid away from said container base.

In embodiments, the lid further includes a visible indication associated with the first press location suggesting that pressure be applied to the first press location, a visible indication associated with the first graspable member suggesting that the first graspable member be lifted a visible indication associated with the second press location suggesting that pressure be applied to the second press location, and a visible indication associated with the second graspable member suggesting that the second graspable member be lifted.

In some of these embodiments, the steps of flexing the first graspable member and flexing the second graspable member are conducted concurrently.

Yet another general aspect of the present invention is a method for using and opening a container assembly. The method includes engaging a lid with a container base by cooperatively locking a lid engagement feature provided in the lid proximal to a peripheral boundary of the lid, with a base engagement feature provided in the container base proximal to a peripheral boundary of the container base, a first graspable member and a second graspable member being attached to the lid proximal to the peripheral boundary of the lid in locations that are not directly opposite to each other, each of said graspable members extending beyond the peripheral boundary of the container base, flexing the first graspable member manually via a user's first hand, thereby rotating the first graspable member upward and disengaging a first portion of the lid engagement feature from a corresponding first portion of the base engagement feature, creating a first region of disengagement therebetween, flexing the second graspable member manually via the user's second hand, thereby rotating the second graspable member upward and disengaging a second portion of the lid engagement feature from a corresponding second portion of the base engagement feature, creating a second region of initial disengagement therebetween; the step of flexing the second graspable member being performed concurrently with the step of flexing first graspable member, and removing the lid from the container base by lifting the lid away from said container base.

Some embodiments further include the steps of pressing on a first press area of the lid with said first hand while concurrently flexing said first graspable member, and pressing on a second press area of the lid with said second hand while concurrently flexing said second graspable member. And in some of these embodiments, said first and second press areas are located inwardly from said lid engagement feature proximal to said peripheral boundary of the lid.

One general aspect of the present invention is a lid and container base, the lid being adapted for engagement with the container base and easy release therefrom. The lid and container base include a container base having a container bottom wall, a container sidewall that extends upward from said container bottom wall, and a peripheral container lip having a lip horizontal section that extends outward from said container sidewall and a lip undercut section that extends downward and inward from said lip horizontal section, a lid having a lid top, a lid side wall that extends downward from said lid top wall, and a lid engagement feature proximal to a peripheral lid boundary, said lid engagement feature comprising a rim horizontal section extending outward from said peripheral lid boundary and being substantially continuously about the peripheral lid boundary, and a rim undercut section that extends downward and inward from said rim horizontal section, said lid engagement feature being configured for mutual cooperation and engagement with the container lip whereby said rim horizontal section rests on said lip horizontal section and said rim undercut section extends downwardly and inwardly, overlying and adjacently parallel to said lip undercut section, thereby forming a base-lid assembly, and a pair of graspable members extending from said rim horizontal section in locations that are not directly opposite to each other, said graspable members being configured for grasping and flexing the rim undercut section outward and away from the lip undercut section, thereby disengaging the lid engagement feature from the container lip at two locations, from which said disengagement propagates around a portion of the peripheral boundary that is sufficient for allowing separation of the base-lid assembly and release of the lid from the container base.

In embodiments, the graspable members are lift tabs. In some embodiments, the lid is dome shaped. In other embodiments, the graspable members are simultaneously operable with a user's left and right hands respectively. In various embodiments, the graspable members are sequentially operable with at least one of a user's hands.

In certain embodiments, at least one of the graspable members further includes a press location cooperative therewith and located proximally thereto, the press location lying on or inward of said rim horizontal section, such that a user's thumb can press on the press location while at least one of the user's fingers simultaneously lifts said cooperative graspable member. And some of these embodiments further include a visible indication associated with each press location suggesting that pressure be applied to the press location, and a visible indication associated with each graspable member suggesting that the graspable member be lifted.

In embodiments, the graspable members are located at an angular separation of between 20 degrees and 60 degrees. In some embodiments, the graspable members are located at an angular separation of between 25 degrees and 50 degrees.

In various embodiments, the material of construction of the lid is one of: polypropylene (PP), oriented polystyrene (OPS), polyethylene terephthalate (PET), styrene butadiene copolymer, and rubber modified styrene.

In embodiments, the peripheral lid boundary is substantially round. In other embodiments, the peripheral lid boundary is shaped substantially as a polygon. In some of these embodiments, at least one of the graspable members is located at a vertex of the peripheral boundary of the lid. In other of these embodiments, the pair of graspable members are located adjacent to either side of a vertex of the peripheral boundary of the lid.

Another general aspect of the present invention is a lid adapted for engagement with a container base and easy release therefrom, the container base having a container bottom wall, at least one container sidewall extending upward from said container bottom wall, a lip horizontal section extending outward from said container sidewall, and a lip undercut section extending downward and inward from said lip horizontal section. The lid includes a lid top, a lid engagement feature comprising a rim horizontal section extending outward from said lid top and substantially continuously about a peripheral lid boundary, and a rim undercut section extending downward and inward from said rim horizontal section, said lid engagement feature being configured for mutual cooperation and engagement with the container lip whereby said rim horizontal section rests on said lip horizontal section and said rim undercut section extends downwardly and inwardly, overlying and adjacently parallel to said lip undercut section, thereby forming a base-lid assembly, a pair of graspable lift tabs extending from said rim horizontal section in locations that are not directly opposite to each other, said graspable members being configured for simultaneous grasping and flexing by left and right hands of a user, and first and second press locations cooperative with the lift tabs and located proximally thereto, each of the press locations lying on or inward of said rim horizontal section, such that the user's thumbs can press on the press locations while at least one finger of each of the user's hands simultaneously lifts each of said lift tabs, thereby flexing the rim undercut section outward and away from the lip undercut section and disengaging the lid engagement feature from the container lip at two locations, from which said disengagement propagates around a portion of the peripheral boundary that is sufficient for allowing separation of the base-lid assembly and release of the lid from the container base.

In embodiments, the container base is a substantially flat tray. Some embodiments further include a visible indication associated with each press area suggesting that pressure be applied to the press area, and a visible indication associated with each lift tab suggesting that the lift tab be lifted.

In various embodiments, the lid is made by a thermoforming process. In certain embodiments, the lid is made by an injection molding process. In some embodiments, the lid is made from polypropylene (PP) resin. And in other embodiments, the lid is made from polyethylene terephthalate (PET) resin.

And in embodiments, the lid is thermoformed from an oriented polystyrene sheet.

The features and advantages described herein are not all-inclusive and, in particular, many additional features and advantages will be apparent to one of ordinary skill in the art in view of the drawings, specification, and examples of claims. Moreover, it should be noted that the language used in the specification has been principally selected for readability and instructional purposes, and not to limit the scope of the inventive subject matter.

BRIEF DESCRIPTION OF THE DRAWINGS

The invention will be better understood upon reading the following Detailed Description in conjunction with the drawings in which.

DETAILED DESCRIPTION OF THE INVENTION

The present invention is generally directed towards a lid that can be securely engaged with a tray or container base and yet is readily removable without unduly disturbing the contents of the tray-lid assembly and without applying undue stress to the lid. The following description of one or more embodiments, in conjunction with the accompanying drawings, are offered by way of illustration only, and should not be regarded as restricting the scope of the invention.

Note that except where the context requires a more specific definition, the term "tray" is used herein to refer generically to a tray, platter, dish, container, plate, or any other support base compatible with a lid or cover, and the term "lid" is used generically herein to refer to any sort of lid or cover compatible with a tray, including flat lids and "dome" lids that are round, rectangular, or any other shape.

Note also that while the discussion that follows is presented in the context of describing features of a lid that enable removal of the lid from a tray, the roles of the lid and the tray can be reversed without departing from the scope of the invention, so that some or all of the features ascribed in embodiments herein to the "lid" (or upper element) can be incorporated into the "tray" (or lower element) of the tray-lid combination. Therefore, the invention applies generally to separable halves of a containing assembly, whereby terms used for convenience to describe one half of the containing assembly, such as "lid" and "cover," can generally be exchanged herein with terms used to describe the other half of the containing assembly, such as "tray," "container," and "support base," without departing from the meaning or scope of the invention.

As will become readily apparent from the following description, a lid that is easy to use and can be readily removed without damaging the lid according to the present invention provides several advantages over prior art lids and tray-lid assemblies. In the case of a food-containing tray-lid assembly, the present invention enables a user to comfortably remove the lid from a tray or other container base with relative ease and without unduly disturbing any of the food items contained within the tray-lid assembly. In particular, the release features or mechanism of the present invention enables lid removal without use of excessive force, which could otherwise result in tearing or damaging of the lid during removal. Being undamaged, the lid can be reattached to the tray and reused as needed.

Figure 1A:
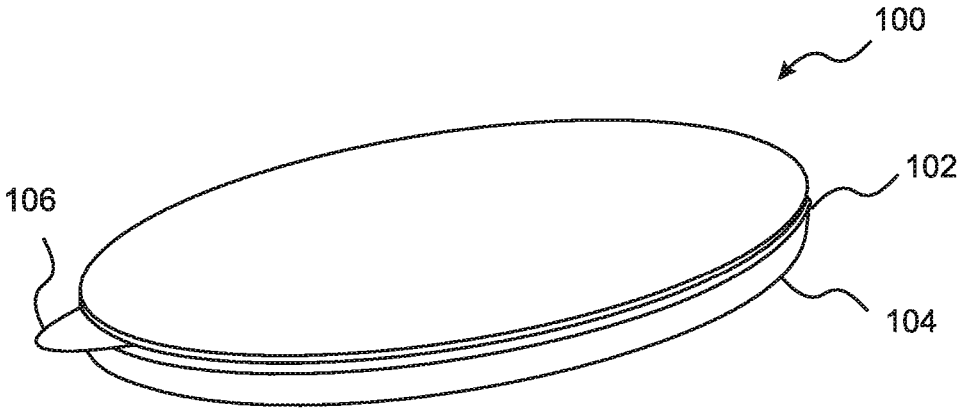
FIG. 1A Prior Art
FIG. 1A is a perspective view drawn to scale of a simple lid of the prior art having a single lift tab.
Figure 1B:
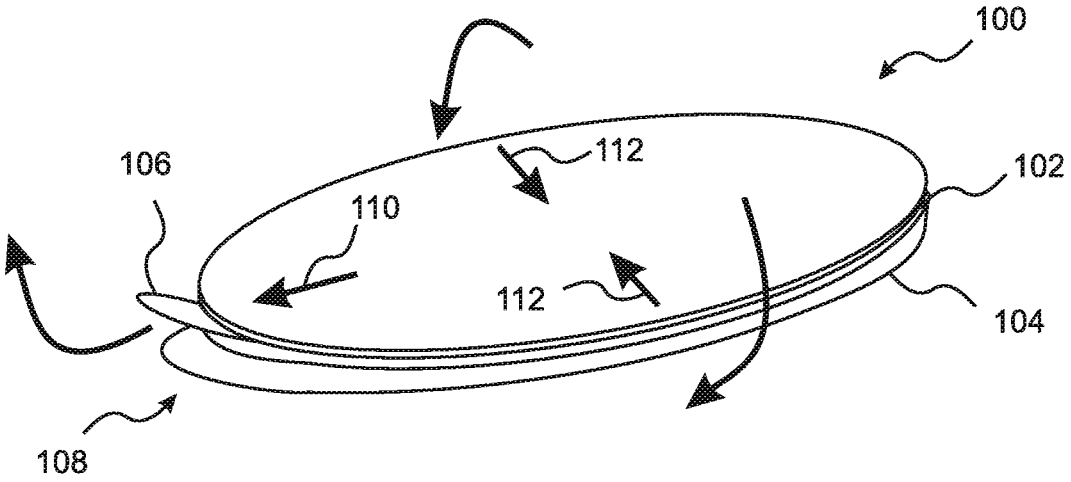
FIG. 1B Prior Art
FIG. 1B is a perspective view drawn to scale of the simple lid of FIG. 1A, illustrating lifting of a single lift tab and consequent opposing inward distortion of the lid that grips the tray and hinders release of the tray from the lid.

FIG. 1A illustrates a simple lid 100 of the prior art. Lid 100 includes a groove 102 into which a lip of a tray (not shown) can be inserted for secure engagement therewith. Lid 100 also includes a skirt 104 that extends downwardly from the groove 102. A tab 106 is provided in an attempt to facilitate removal of lid 100 from a tray. As illustrated in FIG. 1B, lifting of the tab 106 causes an initial separation between the groove 102 and the rim of the tray in a region 108 immediately proximal to the tab 106. However, lifting the tab 106 also necessarily leads to an outwardly radial elongation 110 of the groove 102 toward the tab 106, and consequently orthogonal, inwardly radial forces 112 on opposing sides of the groove 102. These opposing, inwardly radial forces 112 cause the groove 102 to be tightly pressed toward the rim of the tray as the tab 106 is lifted, thereby causing removal of the lid 100 to be very difficult. In the resulting struggle to overcome this gripping force 112, food or other contents of the tray-lid assembly can be disturbed, and in extreme cases the lid material can fail and the lid 100 can be damaged.

A lid designated by reference numeral 10, according to an embodiment of the present invention, is shown in FIGS. 2 through 6, wherein like reference numerals represent like parts. Lid 10 is adapted for engaging with a tray or container base, and as particularly shown in FIG. 6, lid 10 is shown in a superjacent relationship with tray 30 and is engaged therewith.

In FIGS. 2 through 6, lid 10 is shown with a plurality of ornamental design features, however, it will be apparent to those skilled in the art that the utilitarian structural features of the present invention can be readily utilized with or without a variety of aesthetic and/or ornamental lid designs, and that the features of the present invention are not limited to a particular lid style or design. Thus, variations in the lid sidewall and top wall are within the scope of the present invention, and do not affect the ease of use and release functionality described herein. Additionally, the height of the lid 10 is shorter or taller in certain embodiments, and/or the lid sidewall in some embodiments includes upright ribs and/or the lid top wall includes a combination of structural features, including a shape other than a flat top, such as a rounded shape.

Figure 2:
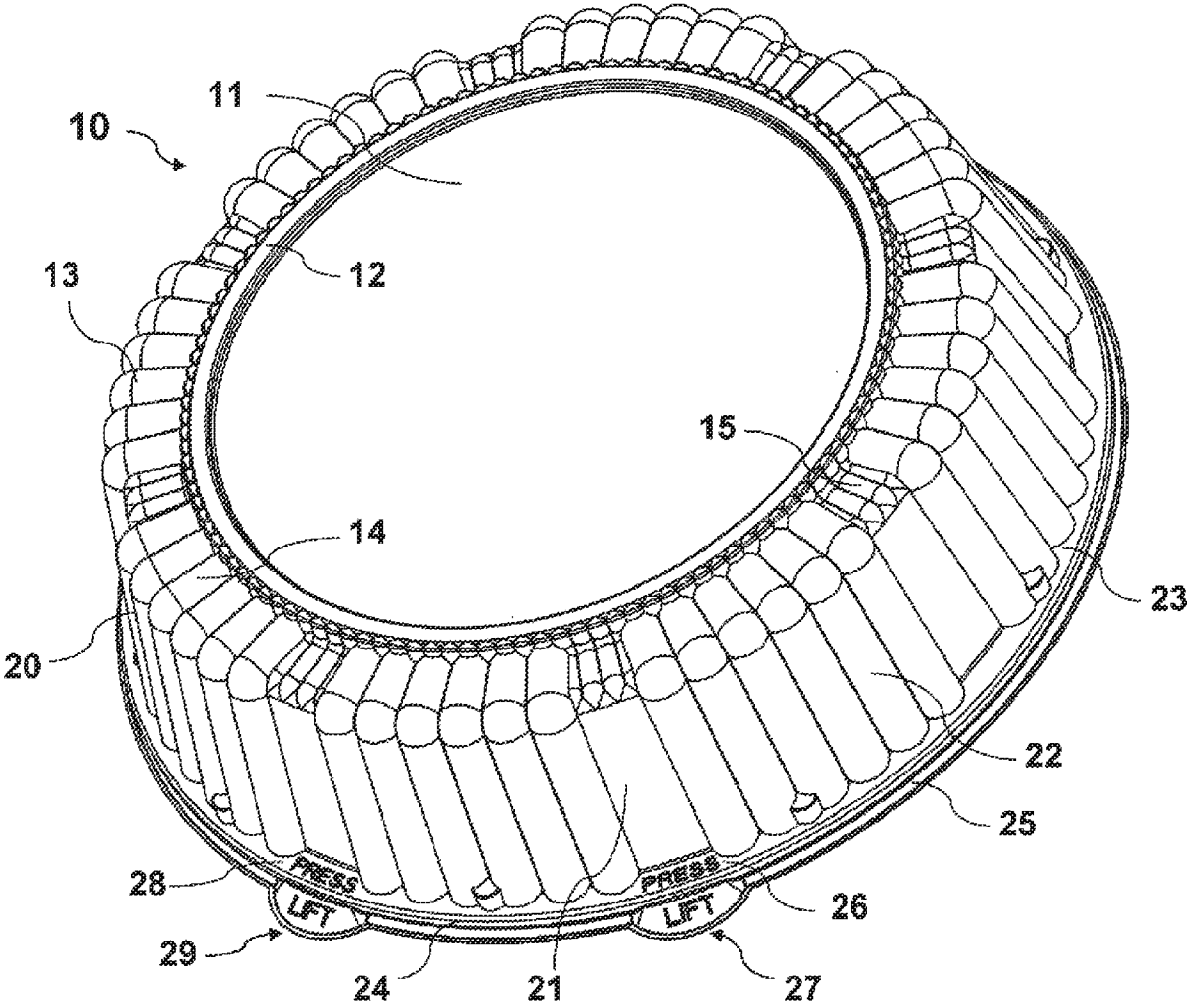
FIG. 2 is a perspective view drawn to scale of a dome lid according to an embodiment of the present invention.
Figure 3:
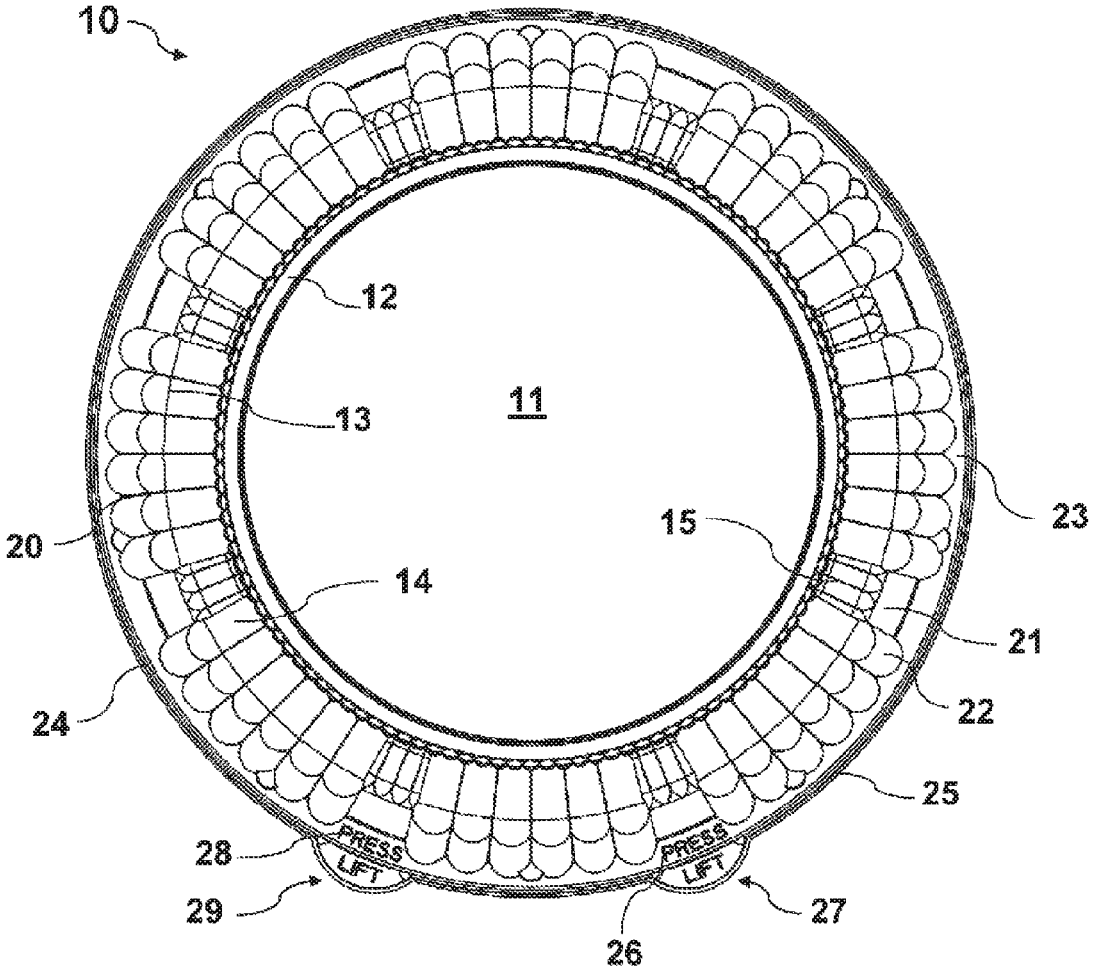
FIG. 3 is a top view drawn to scale of the lid of FIG. 2.

As shown in FIG. 2, the container lid 10 of the illustrated embodiment integrally comprises a generally planar central top wall 11; a raised shoulder portion 12 circumscribing or encircling top wall 11; a peripheral top portion 13 circumscribing raised shoulder portion 12; a sidewall 20 extending circumferentially downward from said peripheral top portion 13; a peripheral flange 23 extending outwardly from the bottom end of sidewall 20; a peripheral groove portion 24; and a downwardly projecting peripheral skirt 25.

In the embodiment shown in FIGS. 2-6, central top wall 11 is generally planar and substantially horizontal as shown, and is adapted to allow a user to view the contents of the tray-lid assembly. In other embodiments, the lid is opaque or translucent, and/or has a rounded or other non-planar shape or appearance.

In the embodiment shown in FIGS. 2-6, the raised shoulder portion 12 of lid 10 is adapted for facilitating stacking of another tray-lid assembly on top of lid 10, whereby nesting of the raised shoulder 12 into a recess provided in the bottom of a second tray stacked above the lid 10 serves to stabilize the stacked assembly (or assemblies) and prevent sliding thereof during transportation or while handling and carrying a plurality of stacked assemblies.

Figure 4:
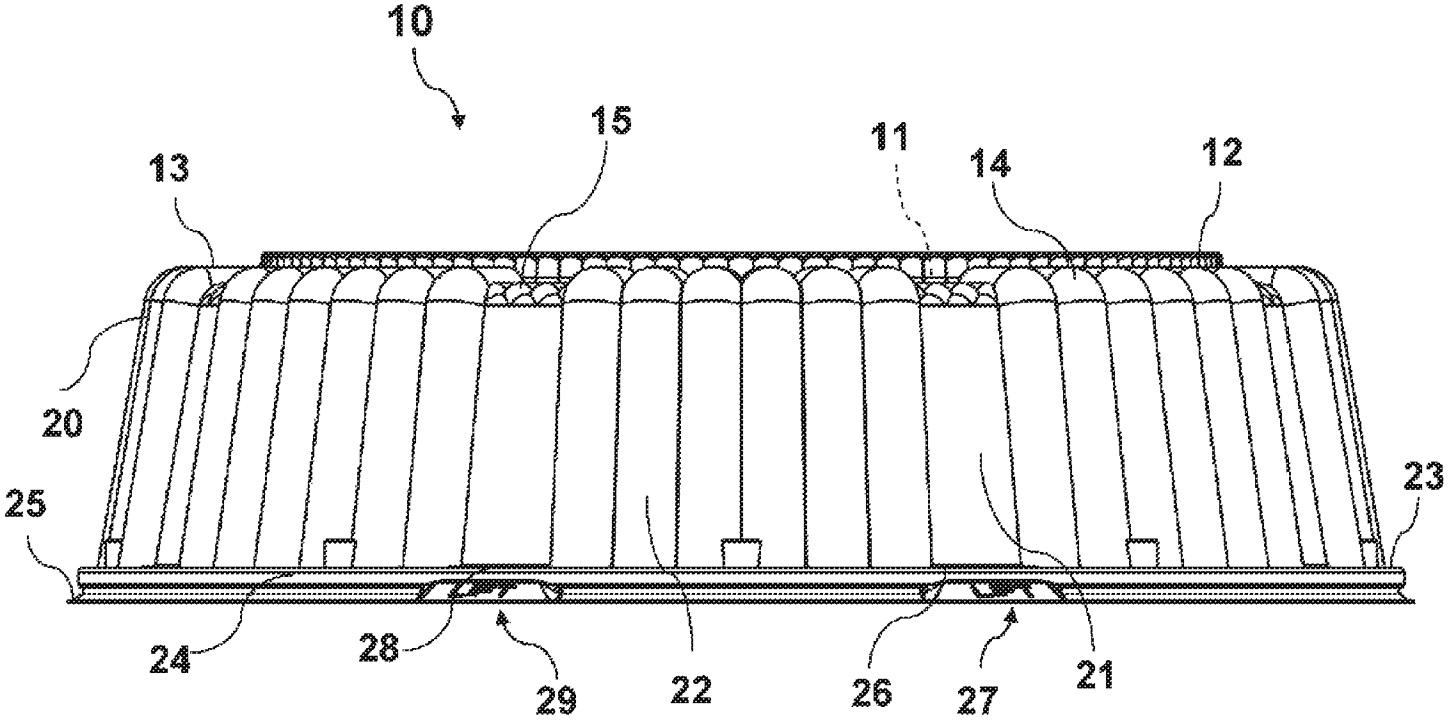
FIG. 4 is a side view drawn to scale of the lid of FIG. 2.
Figure 9A:
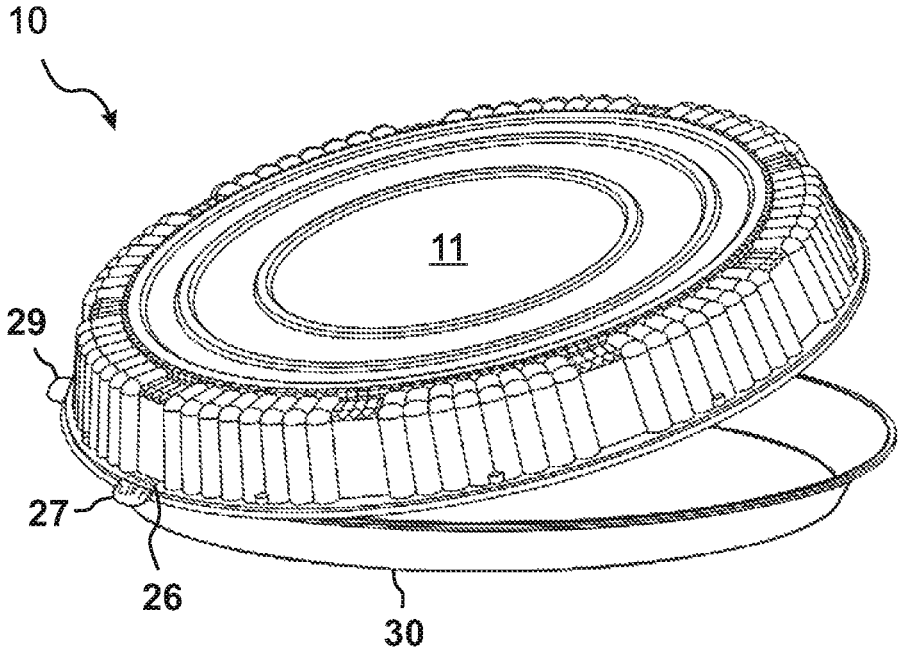
FIG. 9A is a perspective view drawn to scale of the dome lid of FIG. 8 having its lift tabs engaged with the tray and prepared for full engagement of the dome lid with the tray.
Figure 9B:
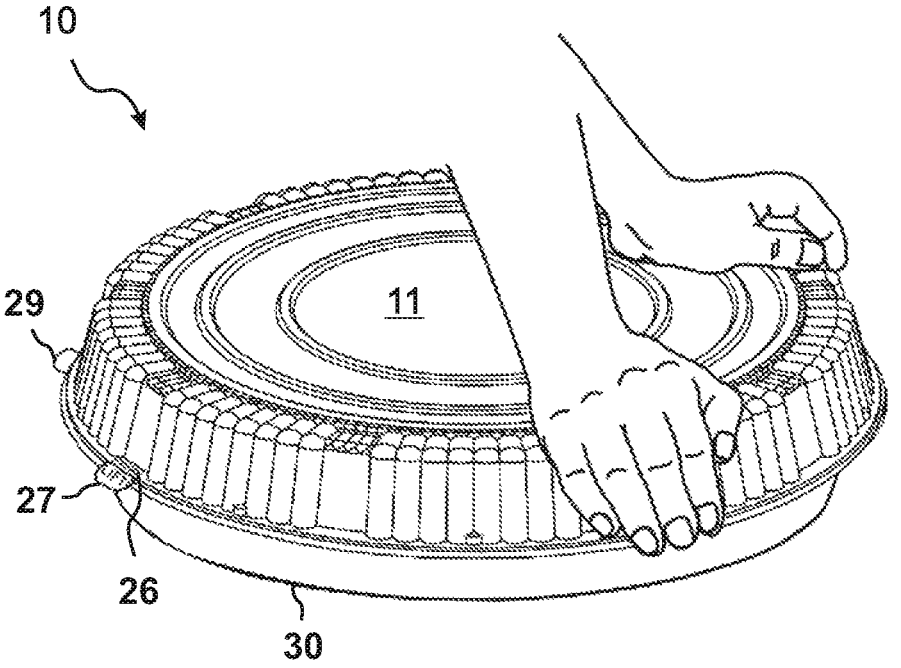
FIG. 9B is a perspective view drawn to scale of the dome lid and tray of FIG. 9A showing pressure being applied to the dome lid so as to attach the dome lid to the tray.

As shown, peripheral top portion 13 may include a variety of ornamental features which also serve as structural stiffening members that strengthen the lid, so that the peripheral top portion 13 can retain its dimensional stability against a downward force typically applied thereto during assembly of lid 10 with a tray or container (see FIG. 9), and when supporting the weight of another tray-lid assembly. In the exemplary embodiment illustrated herein in FIGS. 2-6, peripheral top portion 13 features a plurality of flutes 14 and a plurality of ribs 15. In the illustrated embodiment, the flutes 14 and ribs 15 are organized in sections that form an alternately repeating pattern circumferentially arranged around raised shoulder portion 12. As is best shown in FIGS. 2 and 4, the flutes 14 have an upwardly raised or convex geometry. However it will be appreciated by those skilled in the art that a variety of designs, geometries, patterns and/or other structural elements may be readily imparted to or included in embodiments of the lid of the present invention so as to provide aesthetic appeal and/or structural reinforcement.

As is best shown in FIG. 4, sidewall 20 extends downwardly from peripheral top portion 13 and tapers radially outwardly so as to provide a gradual draft angle for ease of processing and so as to facilitate mold release during the thermoforming process or during any other processing method used for manufacturing lid 10. Sidewall 20 includes a plurality of panels 21 and flutes 22 that are circumferentially arranged in an alternately repeating pattern therein. The bottom end of sidewall 20 is connected to peripheral flange 23 which is generally horizontal in the embodiment of FIGS. 2-6.

Based on the views shown in various figures herein, it should be readily apparent that relative terms such as "horizontal" are used only for illustrative purposes in describing embodiments of the invention, and that more general terms such as "planar" can be substituted without departing from the scope of the invention. Furthermore modifiers such as 'generally' and 'substantially' are intended to be construed liberally. Thus, for example, 'generally planar' and 'substantially planar' are intended to allow for irregular deviations from perfectly flat surface and to reasonably broaden terms such as "planar" so as to encompass curved and other non-planar surfaces.

Figure 6:
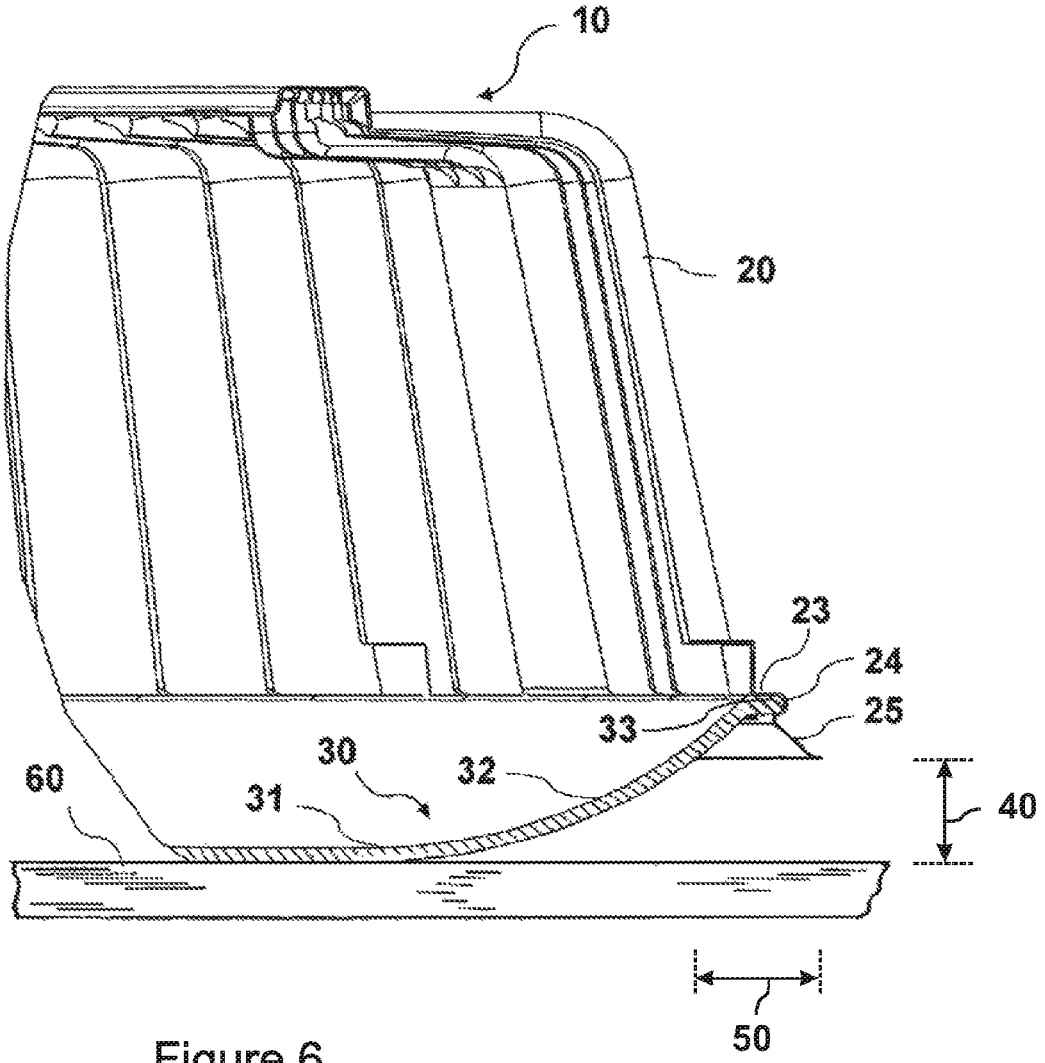
FIG. 6 is a partial cutaway view drawn to scale of a tray-lid assembly according to an embodiment of the invention wherein the lid displays a short peripheral skirt.

As is best shown in FIGS. 4 and 6, peripheral flange 23 rolls downwardly to define a peripheral groove portion 24. Peripheral groove portion 24 has a C-shaped or U-shaped cross section which is adapted for engaging with a tray by receiving a tray lip therein. Referring to FIG. 6, there is shown a cross-sectional view of a tray 30 attached to lid 10. Tray 30 comprises a tray bottom wall 31 resting on a generally horizontal table surface 60, a tray sidewall 32 which extends upwardly and outwardly from the tray bottom wall 31, and a peripheral tray lip 33. In the embodiment of FIG. 6, the peripheral tray lip 33 has a bead-like configuration. In other embodiments, the tray lip includes other features, such as a turned-down configuration (not shown). As shown in FIG. 6, peripheral tray lip 33 nests within the peripheral groove portion 24 of lid 10, and the slight undercut in the groove portion 24 provides a reasonably secure interference fit between the lid 10 and the tray 30.

Lid 10 also features a peripheral skirt 25 which extends downwardly from the underside of the peripheral groove portion 24 and flares radially outwardly. Peripheral skirt 25 facilitates a good lid-fit by guiding the tray lip 33 within the peripheral groove portion 24.

As mentioned above, the present invention provides ease of use and release functionality. The release functionality is accomplished by means of at least two lift tabs. Accordingly, in the embodiment of FIGS. 2-6, lift tabs 27 and 29 are provided in the tray skirt 25. Lift tab 27 is adapted to work cooperatively with press area 26. Lift tab 29 is adapted to work cooperatively with press area 28. Press areas 27 and 28 lie in the peripheral flange 23 proximate to panels 21.

Figure 8:
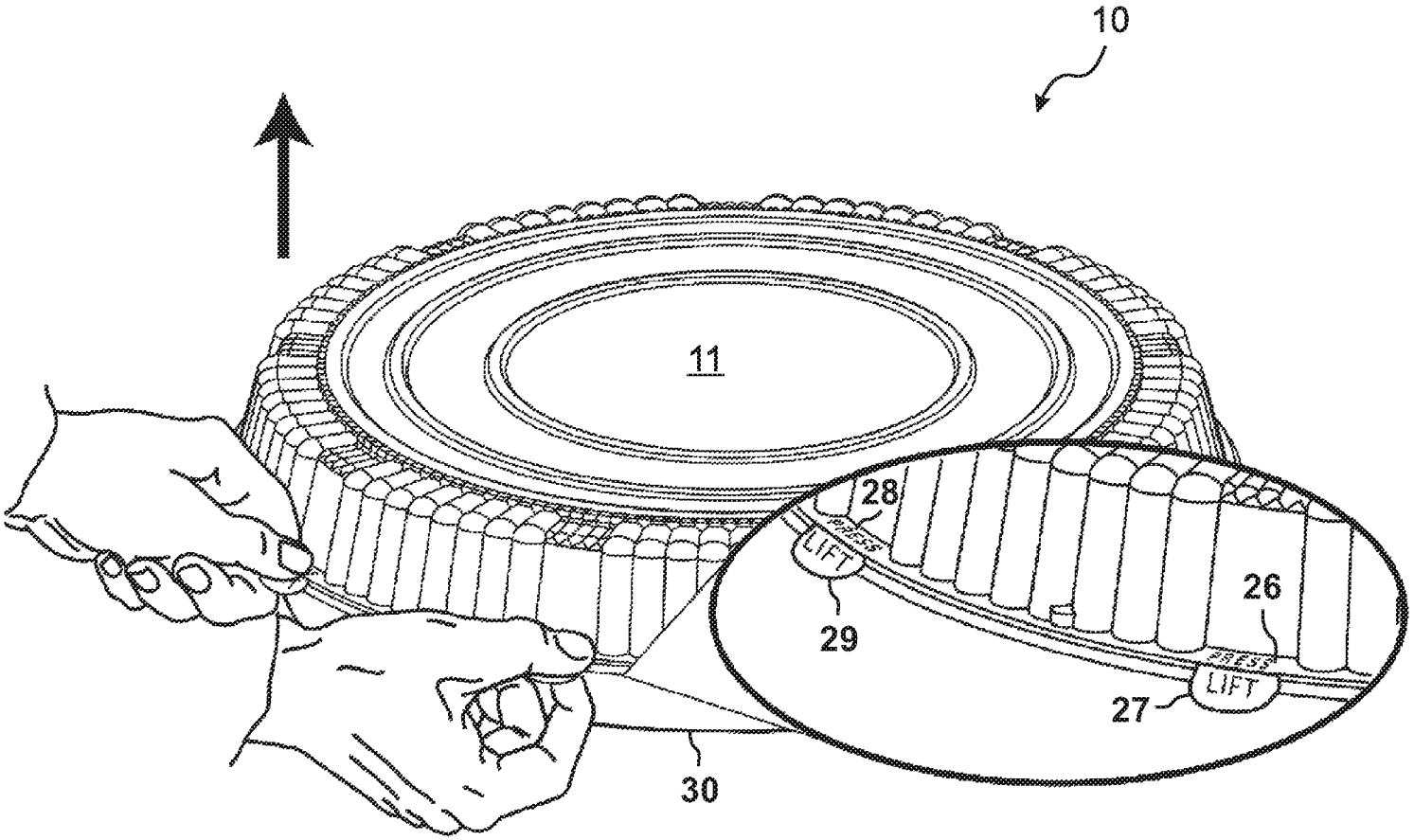
FIG. 8 is a perspective view drawn to scale of a user removing a dome lid from a tray with both hands according to an embodiment of the present invention.

A typical method of removing the lid 10 of the embodiment of FIG. 6 from the tray 30 will now be described. With reference to FIG. 8, during removal of the lid from the tray, a user presses on press area 26 and lifts lift tab 27 with one hand, and concurrently presses on press area 28 and lifts lift tab 29 with the second hand. The lifting action with both hands serves to rotate the tabs upwardly thereby disengaging a sufficient peripheral portion of lid 10 from the peripheral tray lip of the cooperatively engaged tray or container base to allow removal of the entire lid from the tray. The region of initial disengagement extends peripherally away from each point of lifting action in both directions, and may or may not extend continuously between the two points of lifting action. The removal of the lid of the present invention from a tray by a user is graphically shown in FIG. 9. As is best shown in FIGS. 2, 3, 5, and 8, press areas may be indicated by integrally forming or molding the word "PRESS" therein, and lift tabs may be indicated by integrally forming or molding the word "LIFT" therein for the purposes of providing simple lid removal instructions to a user.

Figure 10:
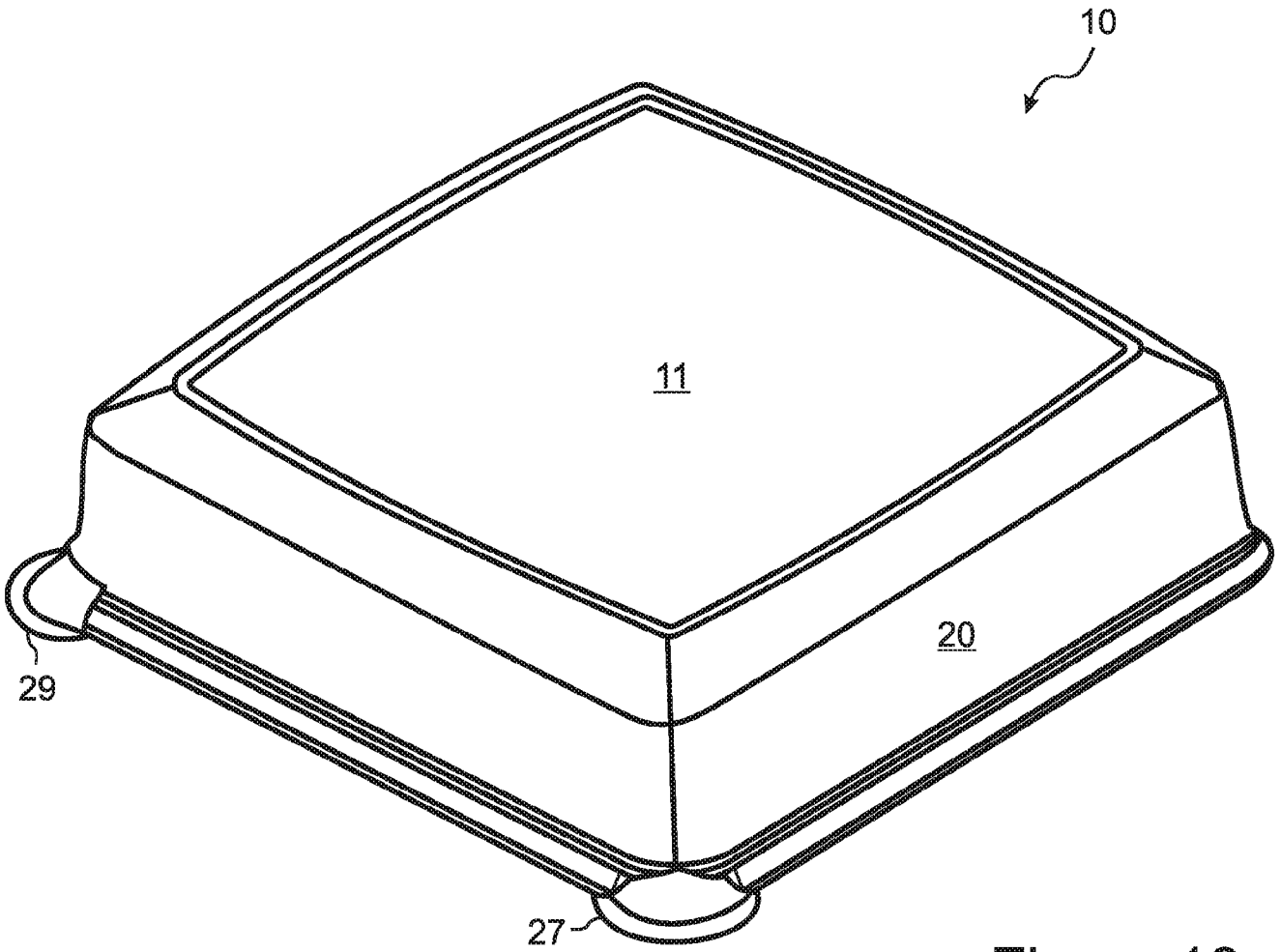
FIG. 10 is a perspective view drawn to scale of a square dome lid with lift tabs at two corners according to an embodiment of the present invention.
Figure 11:
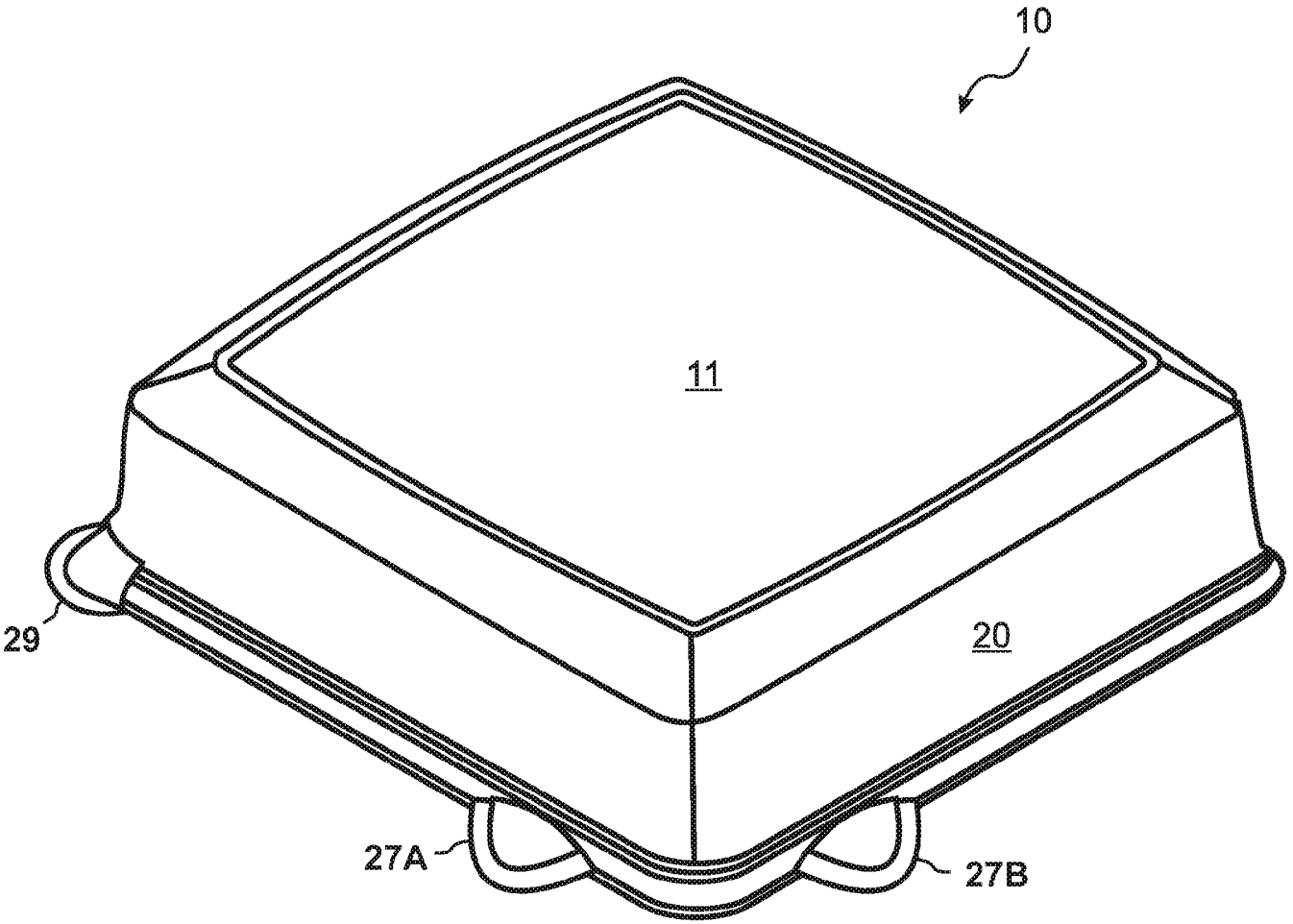
FIG. 11 is a perspective view drawn to scale of a square lid having two lift tabs located on either side of a corner and one additional lift tab located at an adjacent corner, according to an embodiment of the present invention.

Since lift tabs 27 and 29 lie along the peripheral skirt 25, the arcuate distance between lift tab 27 and 29 can be optimized for allowing a user to comfortably grip the respective tabs with both hands and for providing a convenient release from the tray. According to some embodiments of the invention, the arc angle between lift tabs 27 and 29 varies from 20 to 60 degrees, and according to some embodiments of the invention the arc angle between the lift tabs is between 25 to 50 degrees. Polygon-shaped trays and lids can have lift tabs located at two or more adjacent corners, as illustrated in FIG. 10. In other embodiments, two lift tabs are located on either side of one corner, as shown in FIG. 11. Various embodiments that include more than two lift tabs, for example on larger trays and lids, may require sequentially applied lifting actions by which suitable peripheral portions of the lid are disengaged from the tray. It will be appreciated by those of ordinary skill that removing the lid of the present invention with one hand by using a single lift tab is significantly more cumbersome compared to utilizing two of the lift tabs concurrently, or more than two sequentially, for removing the lid from the tray.

Figure 5:
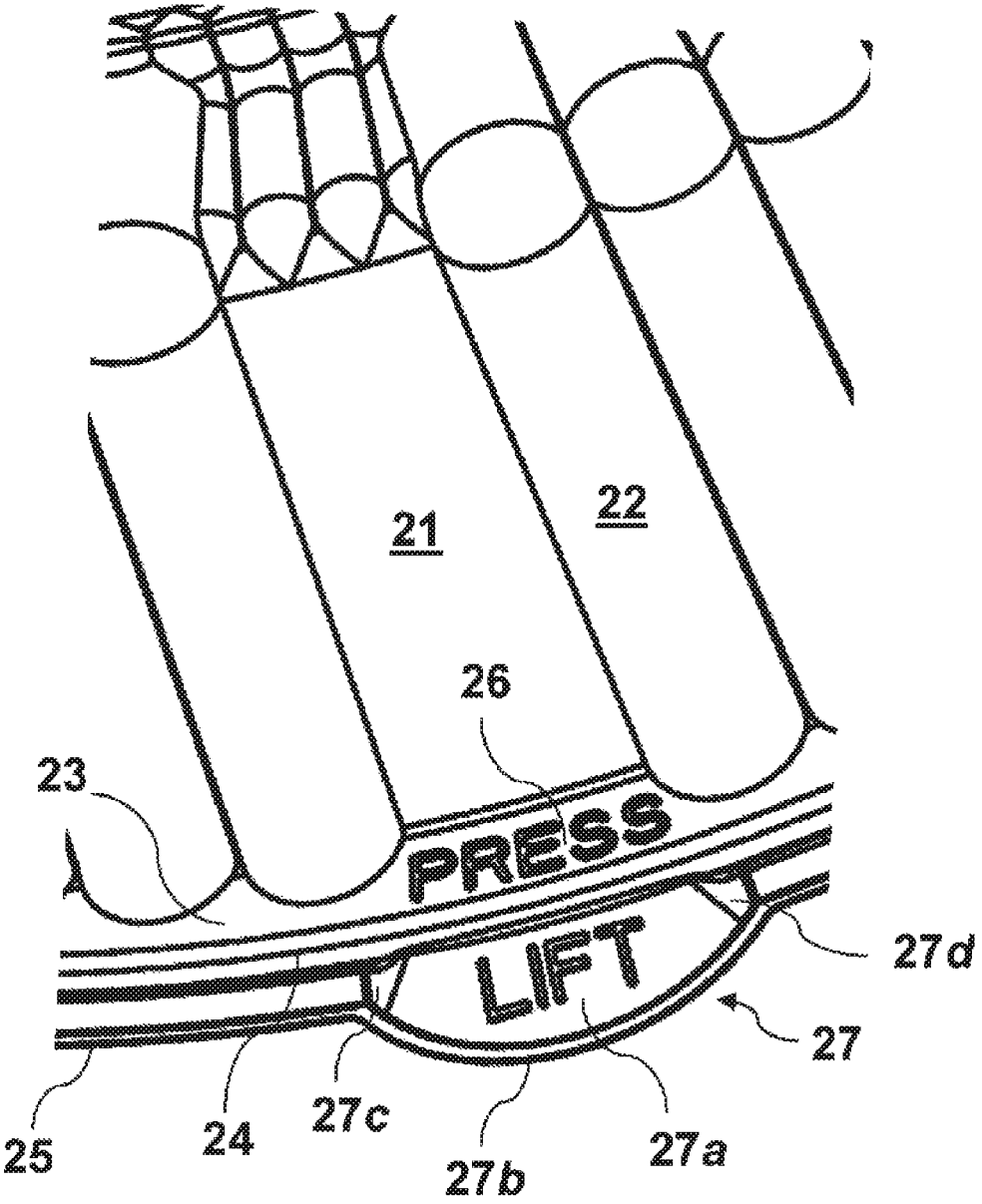
FIG. 5 is an enlarged view drawn to scale of a press area and lift tab of the lid of FIG. 2.

FIG. 5 shows an enlarged view of one of the lift tabs, particularly lift tab 27. Lift tab 27 features a front wall 27*a*, an arcuate front end 27*b*, and a pair of wedge-shaped side ends 27*c* and 27*d*. Front wall 27*a* may be curved outwardly to allow lifting or flexibly turning or rotating of the tab 27 upward, and thereby locally disengaging the peripheral groove portion 24 from tray 30. Local disengagement of peripheral groove portion 24 from tray 30 at both tab locations 27 and 29 sufficiently disturbs the lid engagement to allow an easy removal of the lid from the tray or container base. It will be realized that tabs 27 and 29 can feature a variety of shape configurations which are all deemed within the scope of the invention, including rectangular, button-shaped, or other structural shapes and appearances.

According to an embodiment of the invention, the peripheral groove portion 24 and lift tabs 27 and 29 are adapted for detachably engaging and fitting lid 10 with a tray or container base 30. Accordingly lid 10 is constructed of suitable materials to allow engagement and subsequent reengagement if desired by the user.

It will be apparent to those skilled in the art that the lids of the present invention can be made of a suitable thermoplastic material which can be processed by common polymer processing methods known in the art, such as thermoforming or injection molding. The choice of a thermoplastic resin is typically governed by a variety of factors, including cost, resin processability, and other functional requirements of the lid. Accordingly, lids of the present invention can be manufactured by thermoforming and/or injection molding. In some embodiments of the present invention, the lid is thermoformed from a polyethylene terephthalate (PET) sheet material. According to other embodiments of the present invention, the lid is injection molded from a suitable grade of polypropylene resin.

Figure 7:
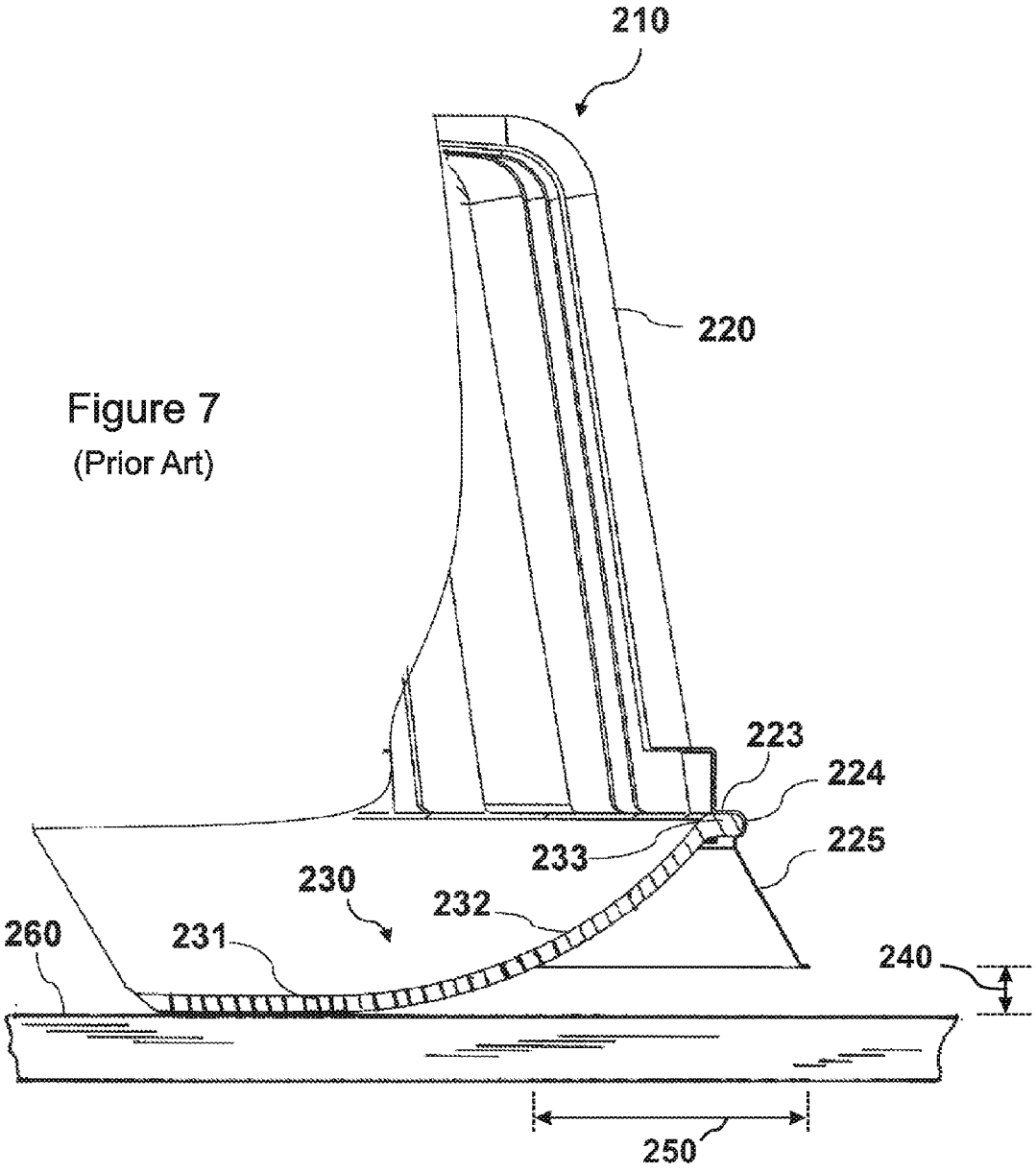
Figure 7 (Prior Art)
FIG. 7 is a partial cutaway view drawn to scale of a tray-lid assembly wherein the lid displays a relatively tall peripheral skirt as typically utilized in dome lids of the prior art.

Certain embodiments of the present invention also include a low profile or short peripheral skirt. As shown in FIG. 6, arrow segment 40 indicates the vertical spacing between the bottom of peripheral skirt 25 and the table surface 60, and arrow segment 50 indicates the horizontal spacing between the outer edge of peripheral skirt 25 and tray sidewall 32. The advantages will be better understood by contrasting the peripheral skirt 25 according to the embodiment of FIG. 6 with the construction of a prior art lid. FIG. 7 illustrates a lid 210 according to the prior art fitted onto tray 230. The peripheral skirt 225 of lid 210 is appreciably longer than peripheral skirt 25 of lid 10. The longer length of peripheral skirt 225 results in a much reduced spacing, indicated by arrow segment 240, between the table surface 260 and peripheral skirt 225. This poses an inconvenience to the user when lifting the tray-lid assembly represented by tray 230 and lid 210. Furthermore, the horizontal distance between the outer edge of peripheral skirt 225 and the tray sidewall 232 represented by arrow segment 250 is also too large for a user to conveniently reach the tray with his or her fingers when lifting the tray-lid assembly, thus requiring the fit between the tray and lid to be sufficiently tight for the tray-lid engagement feature to support the entire weight of the assembly and of any items contained therein. However, in some embodiments of the present invention, the distance between the tray sidewall 32 and the outer peripheral skirt 25 represented by arrow segment 50 is sufficiently short to conveniently allow a user to lift the tray-lid assembly while touching and supporting the tray, thereby reducing the stress or weight felt by the tray-lid engagement features. In addition, allowing a user to hold the tray-lid assembly more securely without relying on just the tray-lid engagement and/or interlocking features also provides ease of use and safety.

As shown in FIGS. 2A-9B, the side wall 20 and top portion 11 of the lid 10 may include a variety of ornamental features which also serve as structural stiffening members that strengthen the lid 10, so that the lid 10 can retain its dimensional stability against a downward force typically applied thereto during assembly of lid 10 with a tray or container 30, and when supporting the weight of another tray-lid assembly. It will be appreciated by those skilled in the art that a variety of designs, geometries, patterns and/or other structural elements may be readily imparted to or included in embodiments of the lid 10 of the present invention so as to provide aesthetic appeal and/or structural reinforcement.

The dual tab feature described above is not limited to round lids, but can be implemented on lids of any shape, including rectangular and square lids. A square lid 10 with two corner tabs 27, 29 according to an embodiment of the present invention is shown in FIG. 10. It will be realized that the positions of the two or more tabs can be optimized to provide ease of release on square and rectangular lids. According to another exemplary embodiment of the invention illustrated in FIG. 11, the two tabs 27A, 27B are located in a proximate relationship about a bottom corner of a square or rectangular lid 10 and are disposed in a slightly offset position from that corner on both sides thereof. In addition, FIG. 11 shows a third lift tab 29 at an adjacent corner. Dual or multiple tabs can thus also be implemented on lids having a general shape such as a polygonal shape. Thus, the exemplary embodiments shown in FIG. 10 and FIG. 11 are illustrative of embodiments of the invention for non-round containers and do not limit the scope of the invention with regards to lid shape and locations of tabs.

As shown in FIGS. 12A-12F, in embodiments of the present invention the container lid 10 integrally comprises a generally planar top portion 11, a sidewall 20 extending circumferentially downward from said top portion 11, a rim horizontal section 23 extending outwardly from the bottom end of sidewall 20, and a rim undercut section 54 extending downward and inward from a peripheral edge of the rim horizontal section 23.

Figure 12A:
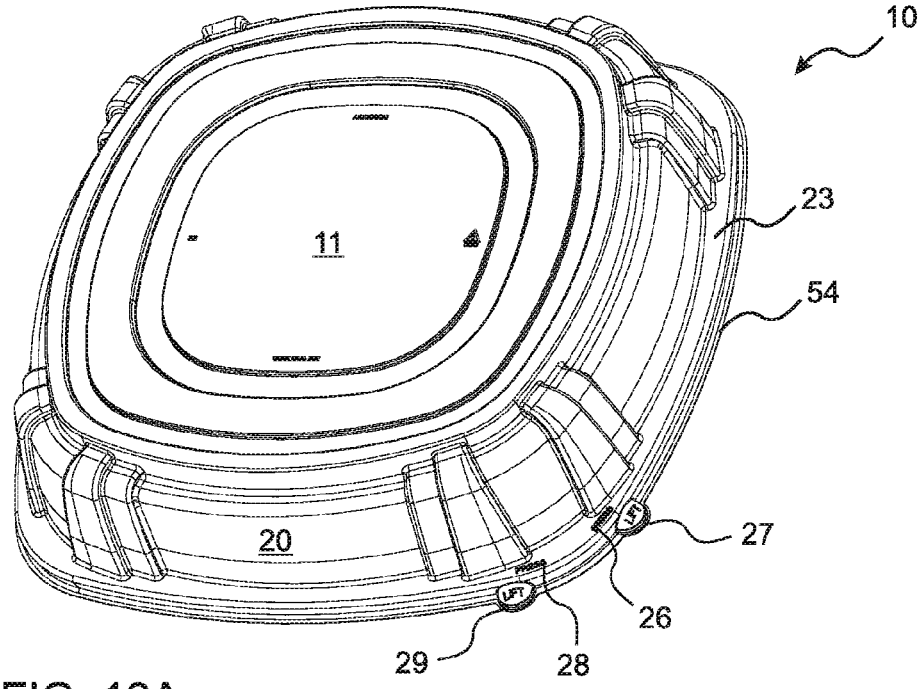
FIG. 12A is a perspective view drawn to scale of a dome lid according to an embodiment of the present invention.
Figure 12B:
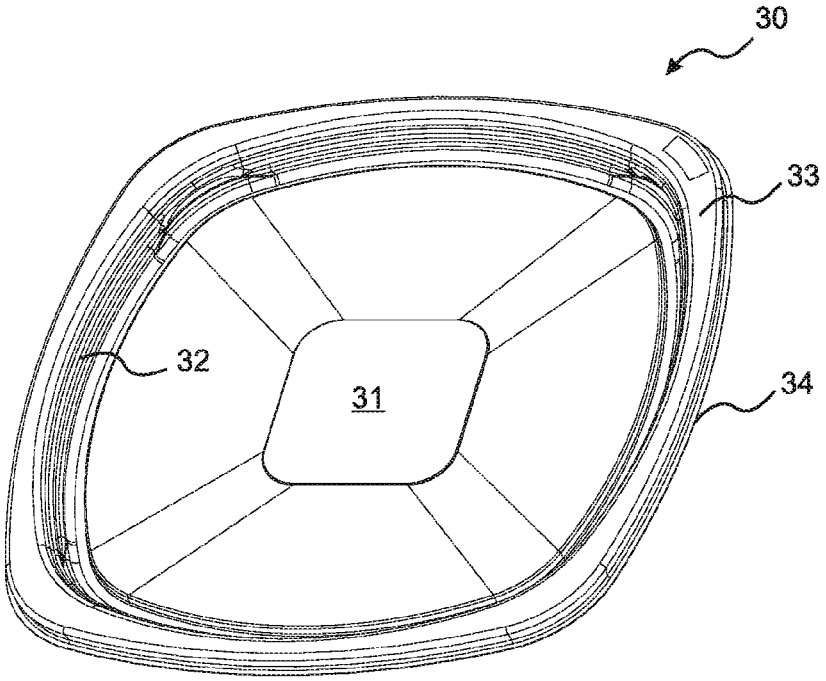
FIG. 12B is a perspective view drawn to scale of a tray that is compatible with the lid of FIG. 12A.
Figure 12C:
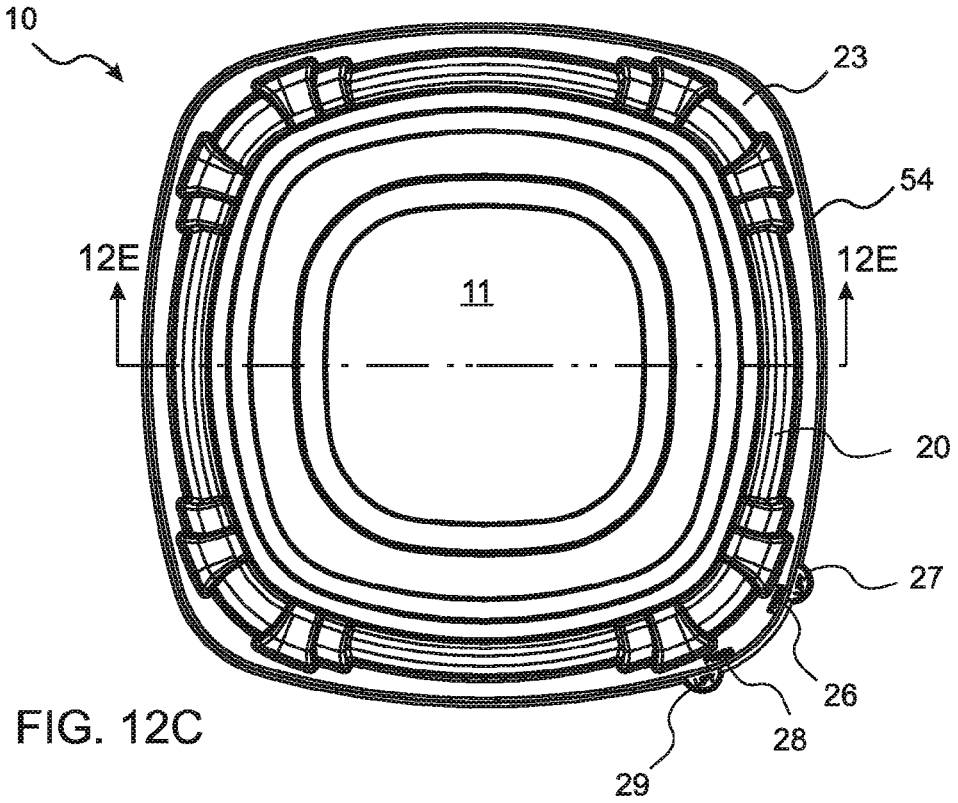
FIG. 12C is a top view drawn to scale of the lid of FIG. 12A.
Figure 12D:
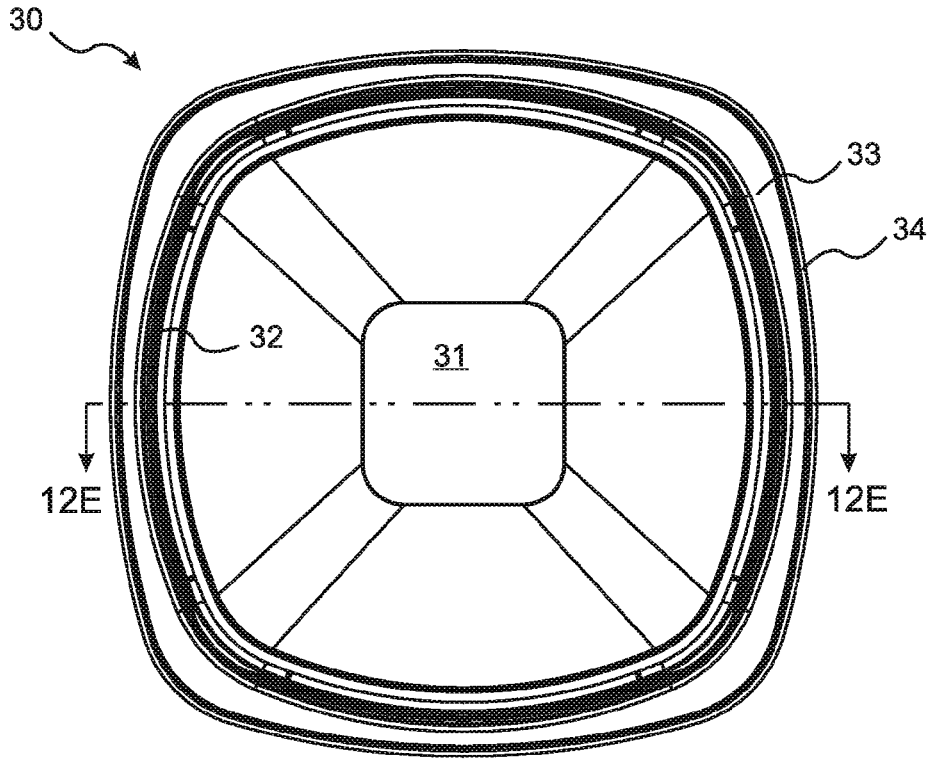
FIG. 12D is a top view drawn to scale of the tray of FIG. 12B.
Figure 12E:
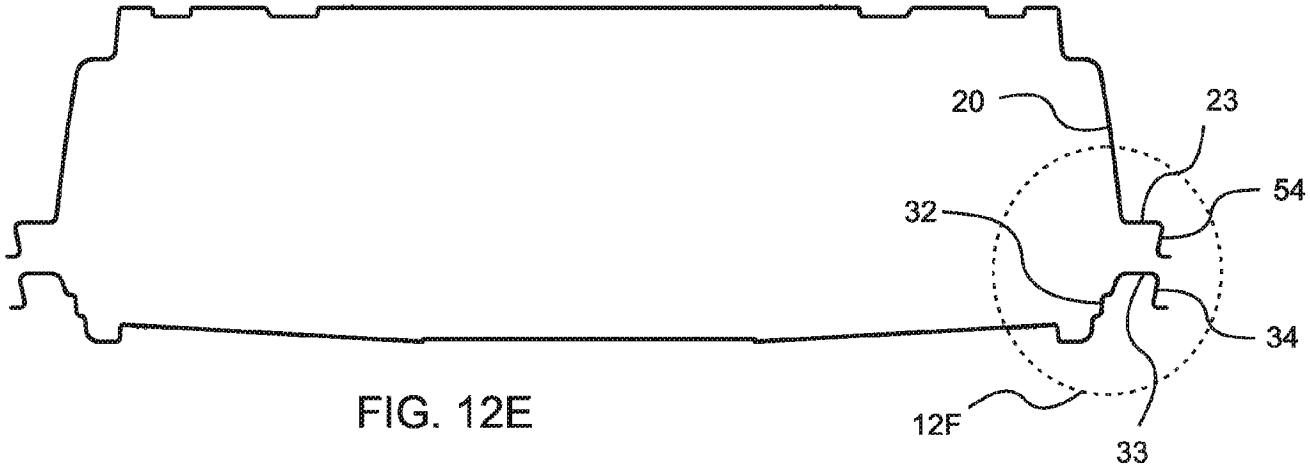
FIG. 12E is a side cross-sectional view drawn to scale of the lid of FIG. 12A positioned above the tray of FIG. 12B.
Figure 12F:
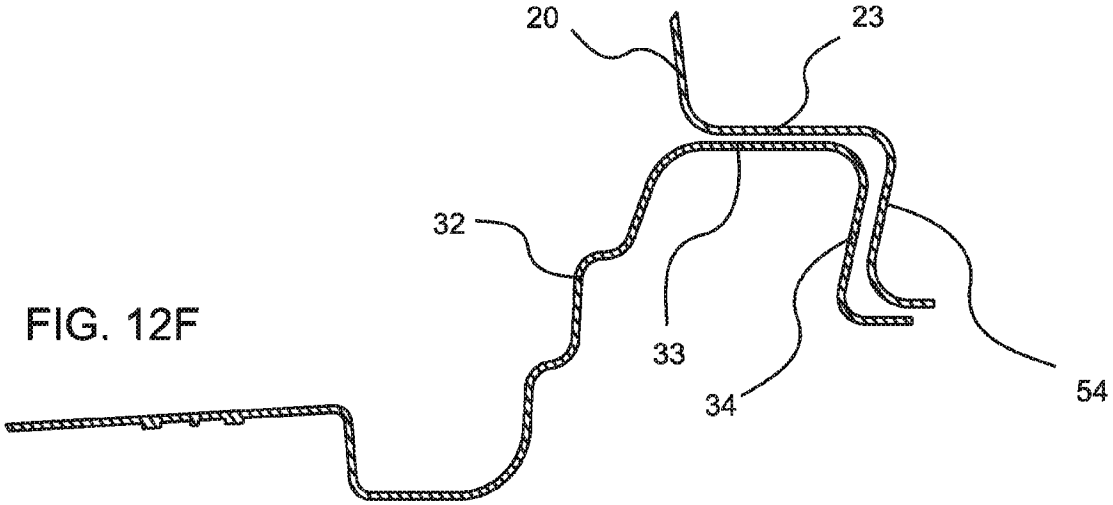
FIG. 12F is an enlarged side cross-sectional view drawn to scale of the rim of the lid of FIG. 12A positioned above the rim of the tray of FIG. 12B, where the locations of the cross sections are shown in FIGS. 12C and 12D.

In the illustrated embodiment, tray 30 comprises a tray bottom 31, a tray sidewall 32 which extends upwardly and outwardly from the tray bottom 31, a lip horizontal section 33, and a lip undercut section 34 extending downward and inward from a peripheral edge of the lip horizontal section 33. As shown in FIG. 12F, when the lid 10 is engaged with the tray 30, the rim horizontal section 23 of the lid 10 rests on top of the lip horizontal section 33 of the tray 30, and the rim undercut section 54 of the lid 10 extends downward and inward from a peripheral edge of the rim horizontal section 23, overlying and adjacently parallel to the lip undercut section 34 of the tray 30, thereby forming a securely engaged tray-lid assembly.

As mentioned above, the present invention provides ease of use and release functionality. The release functionality is accomplished by means of at least two lift tabs 27, 29. In the embodiment of FIGS. 12A-12F, press areas 26, 28 are also provided in the horizontal rim section 23, such that lift tab 27 is adapted to work cooperatively with press area 26, and lift tab 29 is adapted to work cooperatively with press area 28.

Figure 13A:
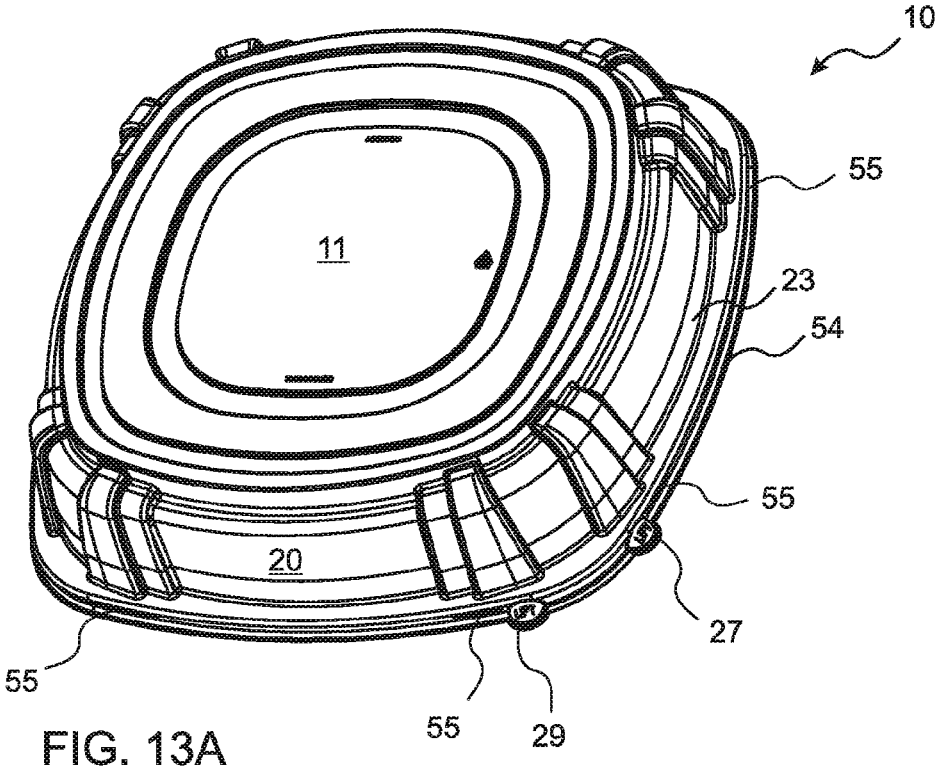
FIG. 13A is a perspective view drawn to scale of a dome lid according to an embodiment of the present invention for which the attachment mechanism includes a cleat.
Figure 13B:
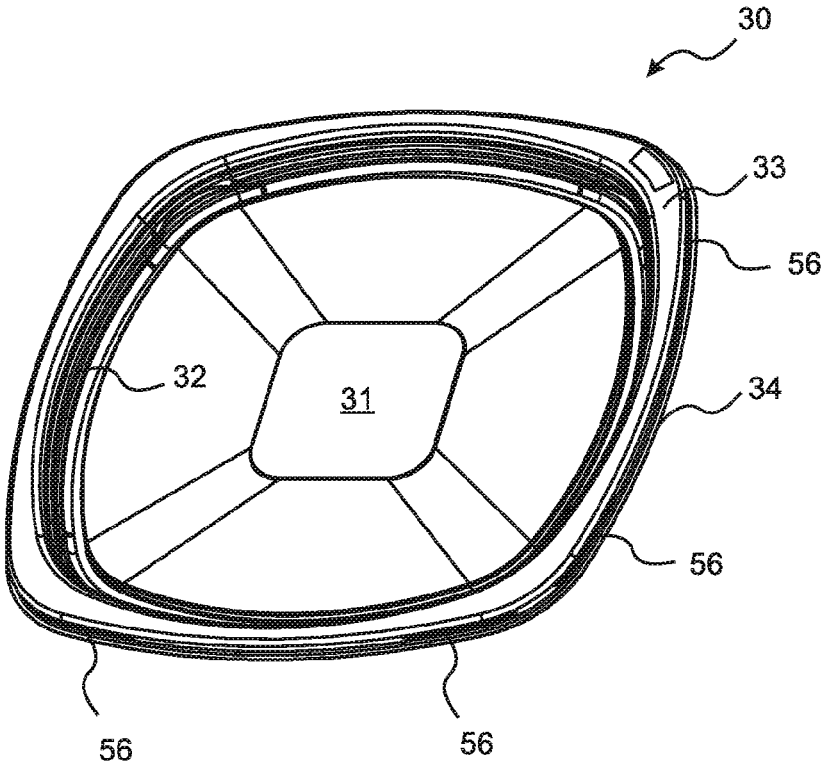
FIG. 13B is a perspective view drawn to scale of a tray that is compatible with the lid of FIG. 13A.
Figure 13C:
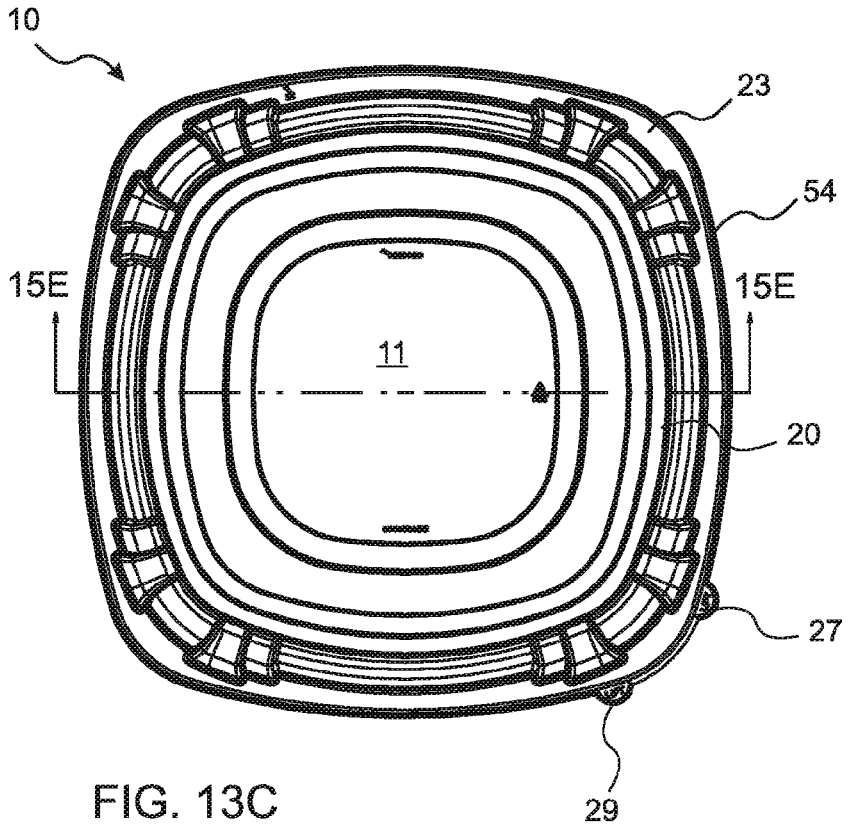
FIG. 13C is a top view drawn to scale of the lid of FIG. 13A.
Figure 13D:
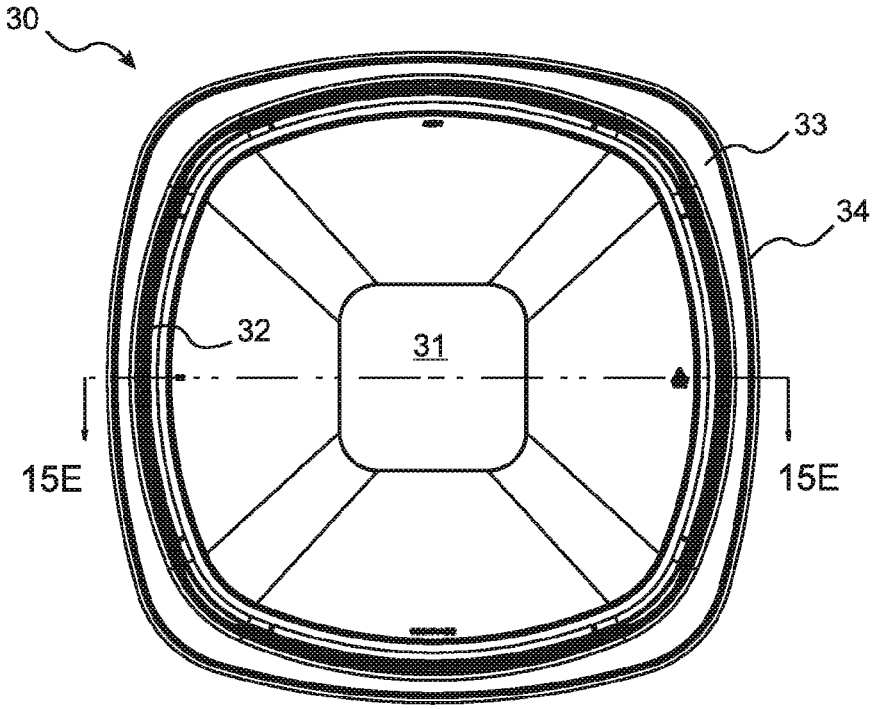
FIG. 13D is a top view drawn to scale of the tray of FIG. 13B.
Figure 13E:
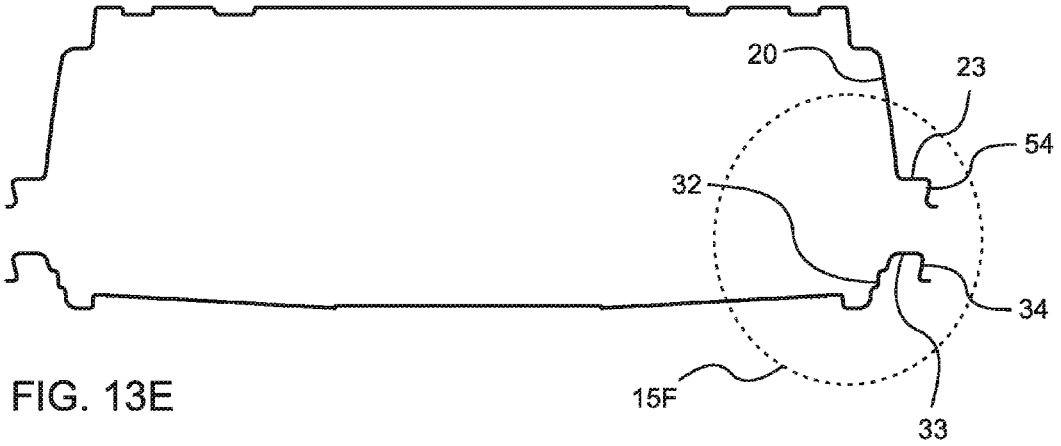
FIG. 13E is a side cross-sectional view drawn to scale of the lid of FIG. 13A positioned above the tray of FIG. 13B.
Figure 13F:
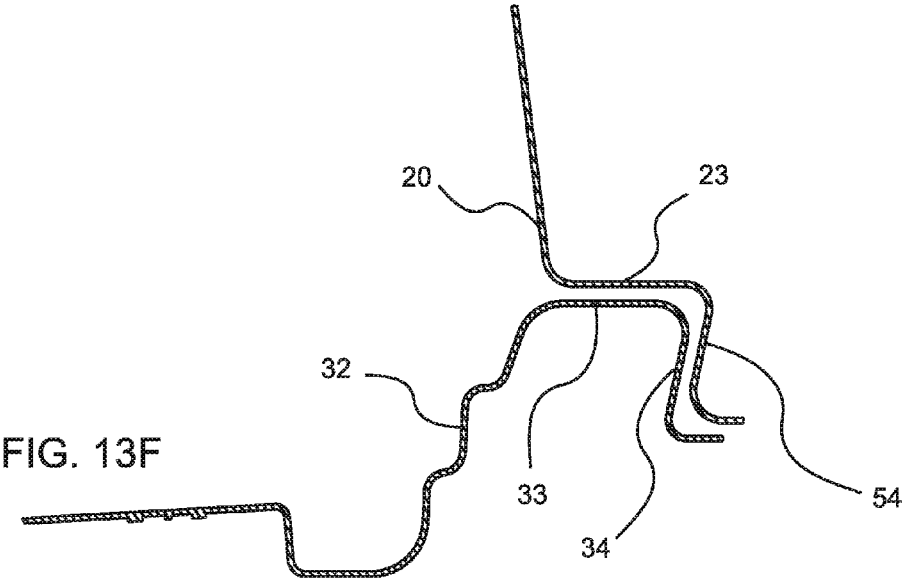
FIG. 13F is an enlarged side cross-sectional view drawn to scale of the rim of the lid of FIG. 13A positioned above the rim of the tray of FIG. 13B, where the locations of the cross sections are shown in FIGS. 13C and 13D.
Figure 14A:
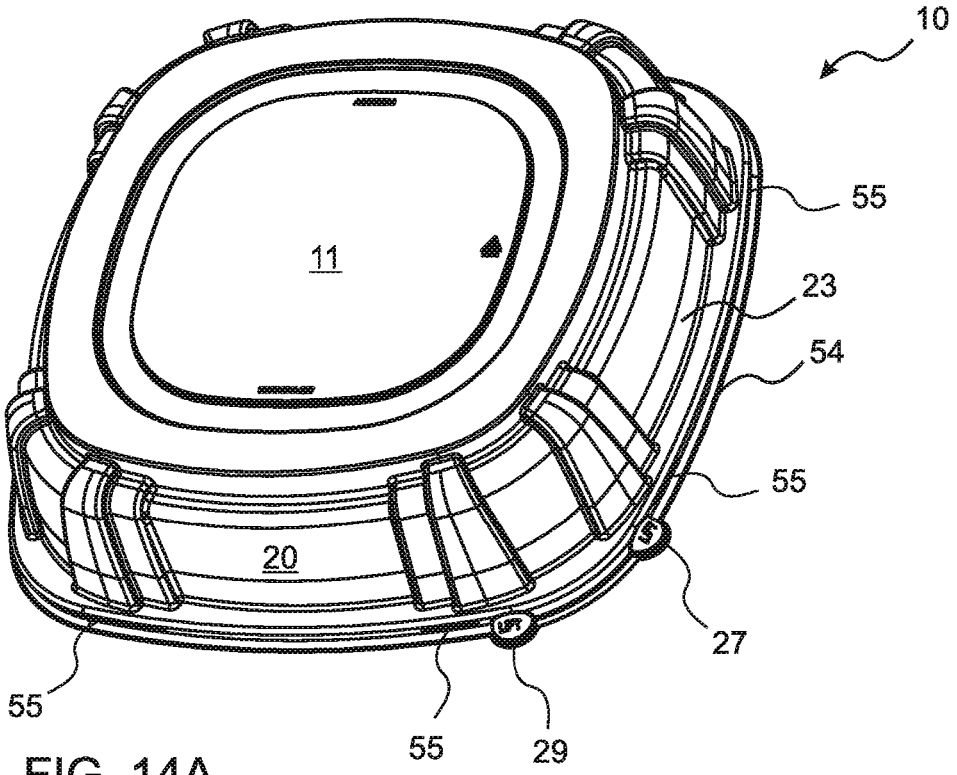
FIG. 14A is a perspective view drawn to scale of a dome lid according to an embodiment of the present invention for which the attachment mechanism includes a cleat.
Figure 14B:
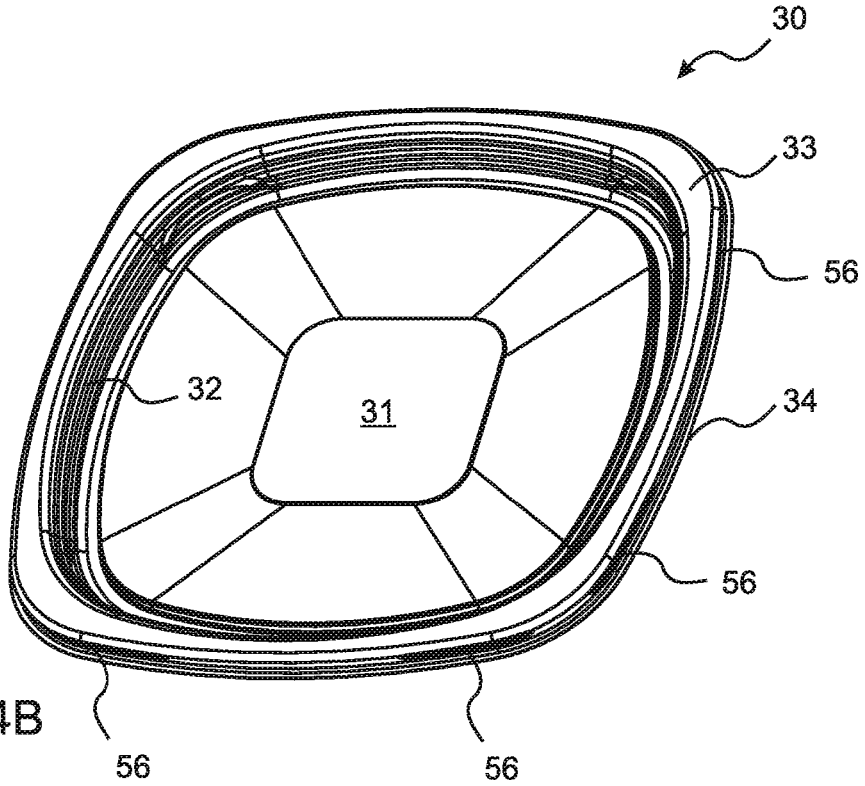
FIG. 14B is a perspective view drawn to scale of a tray that is compatible with the lid of FIG. 14A.
Figure 14C:
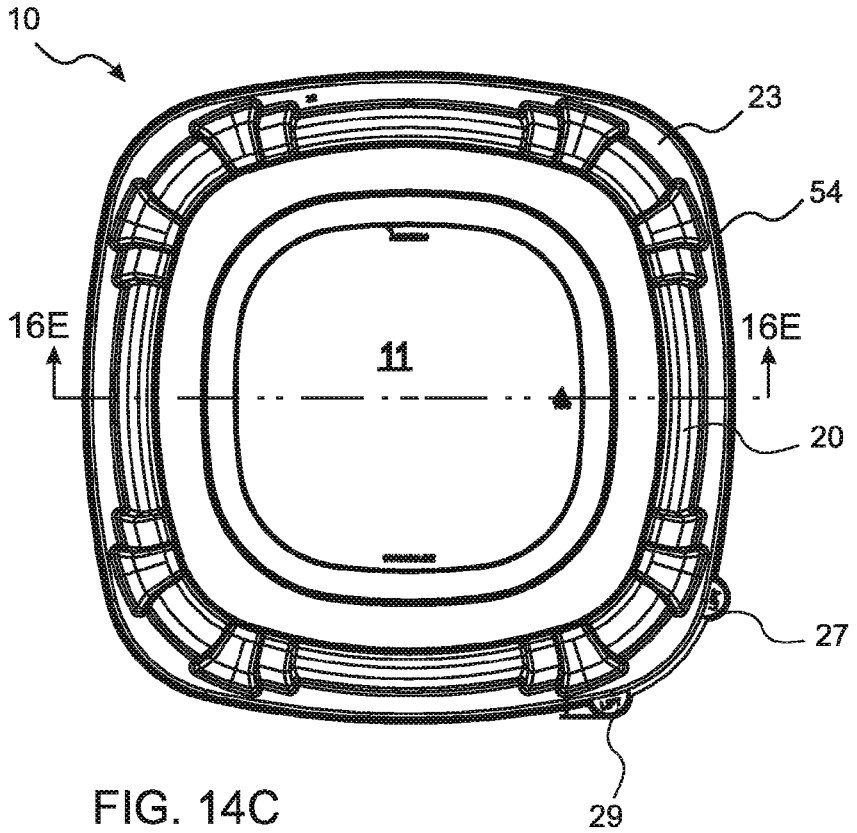
FIG. 14C is a top view drawn to scale of the lid of FIG. 14A.
Figure 14D:
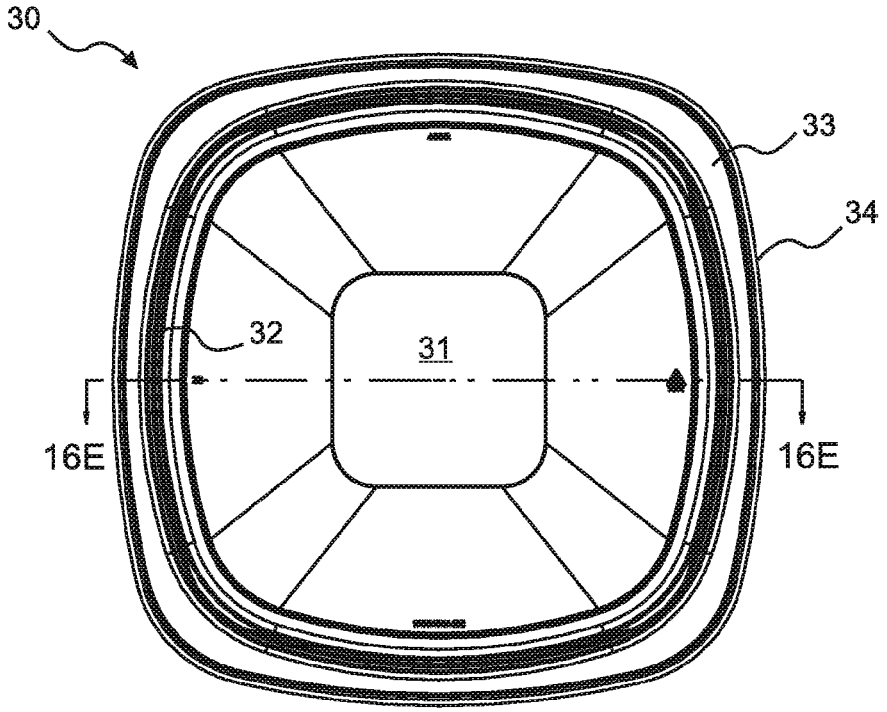
FIG. 14D is a top view drawn to scale of the tray of FIG. 14B.
Figure 14E:
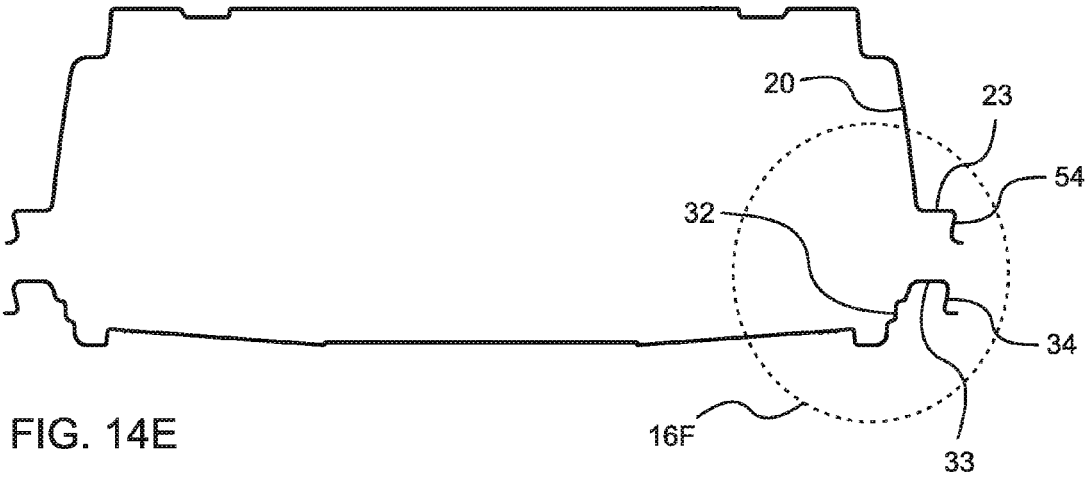
FIG. 14E is a side cross-sectional view drawn to scale of the lid of FIG. 14A positioned above the tray of FIG. 14B.
Figure 14F:
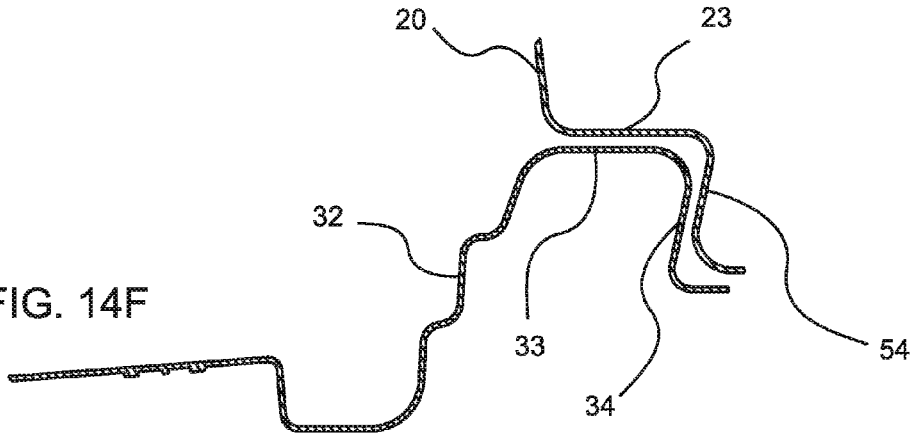
FIG. 14F is an enlarged side cross-sectional view drawn to scale of the rim of the lid of FIG. 14A positioned above the rim of the tray of FIG. 14B, where the locations of the cross sections are shown in FIGS. 14C and 14D.

FIGS. 13A-14F illustrate two additional embodiments that include press locations but do not include visible indications that label the press locations. As can be seen in FIGS. 13B and 14B, the attachment mechanisms of the trays in these embodiments include receiving regions of enhanced engagement or recessions 56 that cooperate with the protruding regions of enhanced engagement or cleats 55 in the attachment mechanisms of the lids respectively, as can be seen in FIGS. 13A and 14A. The regions of enhanced engagement strengthen the attachment of the lid 11 to the container base 31 along the sides of the lid 11, so that the overall attachment of the lid 11 to the container base 31 is not as strongly dependent on the attachment at the vertices. As a result, the attachment at the vertices can be made weaker without reducing the overall lid-tray attachment to an unacceptable degree. This renders inadvertent detachment of the lid 11 unlikely, while allowing the lid 11 to be intentionally released from the container base 31 without requiring the user to apply undue effort, without subjecting the lid 11 to undue stress, and without unduly disturbing the contents of the base-lid assembly. These features are explained in more detail in co-pending U.S. patent application Ser. No. 14/877,001, which is incorporated herein by reference for all purposes.

In all of the illustrated embodiments of the present invention, central top wall 11 is generally planar and substantially horizontal as shown, and is adapted to allow a user to view the contents of the tray-lid assembly. In other embodiments, the lid is opaque or translucent, and/or has a rounded or other non-planar shape or appearance.

The embodiments discussed above all include lids that incorporate lift tab features of the present invention for facilitating separation of a lid from a tray. However, it will be understood by anyone skilled in the art that the same purpose can be accomplished by providing indentation features or recessed locations in the tray for allowing access to a user's hands for grasping and manipulating the lid periphery. Therefore, the graspable tabs can be created by indentations provided in either the tray or the lid. Furthermore, graspable members for manipulating separation of a tray-lid assembly may be configured in the form of lift tabs, push tabs, indentations, or combinations thereof. In addition, it will be understood by those skilled in the art that the features of the present invention can be included in the lower, or "tray" portion of a tray-lid assembly, rather than in the lid.

The foregoing description of the embodiments of the invention has been presented for the purposes of illustration and description. It is not intended to be exhaustive or to limit the invention to the precise form disclosed. Accordingly, the drawing and description are to be regarded as illustrative in nature, and not as restrictive. Many modifications and variations are possible in light of this disclosure. The advantages of the invention may be further realized and attained by means of the instrumentalities and combinations particularly pointed out in the appended claims.

What is claimed is:

1. A lid and container base, the lid being adapted for engagement with the container base and easy release therefrom, the lid and container base comprising:

a container base having a container bottom wall, a container sidewall that extends upward from said container bottom wall, and a peripheral container lip having a lip horizontal section that extends outward from said container sidewall and a lip undercut section that extends downward and inward from said lip horizontal section;

a lid having a lid top, a lid side wall that extends downward from said lid top wall, and a lid engagement feature proximal to a peripheral lid boundary, said lid engagement feature comprising a rim horizontal section extending outward from said peripheral lid boundary and being substantially continuously about the peripheral lid boundary, and a rim undercut section that extends downward and inward from said rim horizontal section, said lid engagement feature being configured for mutual cooperation and engagement with the container lip whereby said rim horizontal section rests on said lip horizontal section and said rim undercut section extends downwardly and inwardly, overlying and adjacently parallel to said lip undercut section, thereby forming a base-lid assembly; and a pair of graspable members extending from said rim horizontal section in locations that are not directly opposite to each other, said graspable members being configured for grasping and flexing the rim undercut section outward and away from the lip undercut section, thereby disengaging the lid engagement feature from the container lip at two locations, from which said disengagement propagates around a portion of the peripheral boundary that is sufficient for allowing separation of the base-lid assembly and release of the lid from the container base.

2. The lid of claim 1, wherein said graspable members are lift tabs.

3. The lid of claim 1, wherein said lid is dome shaped.

4. The lid of claim 1, wherein said graspable members are simultaneously operable with a user's left and right hands respectively.

5. The lid of claim 1, wherein said graspable members are sequentially operable with at least one of a user's hands.

6. The lid of claim 1, wherein at least one of the graspable members further includes a press location cooperative therewith and located proximally thereto, the press location lying on or inward of said rim horizontal section, such that a user's thumb can press on the press location while at least one of the user's fingers simultaneously lifts said cooperative graspable member.

7. The lid of claim 6, further comprising a visible indication associated with each press location suggesting that pressure be applied to the press location, and a visible indication associated with each graspable member suggesting that the graspable member be lifted.

8. The lid of claim 1, wherein the graspable members are located at an angular separation of between 20 degrees and 60 degrees.

9. The lid of claim 1, wherein the graspable members are located at an angular separation of between 25 degrees and 50 degrees.

10. The lid of claim 1, wherein the material of construction of the lid is one of: polypropylene (PP), oriented polystyrene (OPS), polyethylene terephthalate (PET), styrene butadiene copolymer, and rubber modified styrene.

11. The lid of claim 1, wherein said peripheral lid boundary is substantially round.

12. The lid of claim 1, wherein said peripheral lid boundary is shaped substantially as a polygon.

13. The lid of claim 12, wherein at least one of the graspable members is located at a vertex of the peripheral boundary of the lid.

14. The lid of claim 12, wherein the pair of graspable members are located adjacent to either side of a vertex of the peripheral boundary of the lid.

15. A lid adapted for engagement with a container base and easy release therefrom, said container base having a container bottom wall, at least one container sidewall extending upward from said container bottom wall, a lip horizontal section extending outward from said container sidewall, and a lip undercut section extending downward and inward from said lip horizontal section, said lid comprising:

a lid top;

a lid engagement feature comprising a rim horizontal section extending outward from said lid top and substantially continuously about a peripheral lid boundary, and a rim undercut section extending downward and inward from said rim horizontal section, said lid engagement feature being configured for mutual cooperation and engagement with the container lip whereby said rim horizontal section rests on said lip horizontal section and said rim undercut section extends downwardly and inwardly, overlying and adjacently parallel to said lip undercut section, thereby forming a base-lid assembly;

a pair of graspable lift tabs extending from said rim horizontal section in locations that are not directly opposite to each other, said graspable members being configured for simultaneous grasping and flexing by left and right hands of a user; and first and second press locations cooperative with the lift tabs and located proximally thereto, each of the press locations lying on or inward of said rim horizontal section, such that the user's thumbs can press on the press locations while at least one finger of each of the user's hands simultaneously lifts each of said lift tabs, thereby flexing the rim undercut section outward and away from the lip undercut section and disengaging the lid engagement feature from the container lip at two locations, from which said disengagement propagates around a portion of the peripheral boundary that is sufficient for allowing separation of the base-lid assembly and release of the lid from the container base.

16. The lid of claim 15, wherein said container base is a substantially flat tray.

17. The lid of claim 15, further comprising a visible indication associated with each press area suggesting that pressure be applied to the press area, and a visible indication associated with each lift tab suggesting that the lift tab be lifted.

18. The lid according to claim 15, wherein said lid is made by a thermoforming process.

19. The lid according to claim 15, wherein said lid is made by an injection molding process.

20. The lid according to claim 15, wherein said lid is made from polypropylene (PP) resin.

21. The lid according to claim 15, wherein said lid is made from polyethylene terephthalate (PET) resin.

22. The lid according to claim 15, wherein said lid is thermoformed from an oriented polystyrene sheet.

* * * * *